US006412463B1

(12) United States Patent
Kinugawa

(10) Patent No.: US 6,412,463 B1
(45) Date of Patent: Jul. 2, 2002

(54) VALVE TIMING REGULATION DEVICE

(75) Inventor: Hiroyuki Kinugawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/688,868

(22) Filed: Oct. 17, 2000

(30) Foreign Application Priority Data

Oct. 25, 1999 (JP) ..... 11-303068
Jul. 18, 2000 (JP) ..... 2000-217506

(51) Int. Cl.[7] ..... F01L 1/34; F16J 15/16

(52) U.S. Cl. ..... 123/90.17; 123/90.37; 74/568 R; 464/2

(58) Field of Search ..... 123/90.15, 90.17, 123/90.31, 90.37; 74/568 R; 464/1, 2, 160

(56) References Cited

U.S. PATENT DOCUMENTS 3,809,046 A * 5/1974 Kammeraad ..... 123/188.9
4,834,037 A * 5/1989 Lafever ..... 123/188.6
5,865,150 A * 2/1999 Kramer et al. ..... 123/90.17
5,875,750 A * 3/1999 Iwasaki et al. ..... 123/90.17
6,170,447 B1 * 1/2001 Kohrs et al. ..... 123/90.17
6,173,688 B1 * 1/2001 Fukuhara et al. ..... 123/90.17

FOREIGN PATENT DOCUMENTS

JP 10-331613 12/1998 ..... F01L/1/34
JP 11-30111 2/1999 ..... F01L/1/34

* cited by examiner

*Primary Examiner*—Wellun Lo
(74) *Attorney, Agent, or Firm*—Sughrue Mion, PLLC

(57) ABSTRACT

A plate spring is pre-assembled as a unit into a seal member which contains the section between an advancing oil pressure chamber and a retarding oil pressure chamber in a valve timing regulation device. Both the seal member and the plate spring are adapted to be inserted integrally between the sliding faces of the first rotating body and the second rotating body of the valve timing regulation device. Furthermore it is possible to facilitate the insertion of these components. The detachment of the plate spring 32 which is fitted into the indented inner section of the seal member 27 is suppressed and a spring detachment prevention means 31*a*, 31*b* which allows displacement due to resilient deformation of the plate spring 32 is provided in the seal member 27.

12 Claims, 14 Drawing Sheets

VALVE TIMING REGULATION DEVICE

BACKGROUND OF THE INVENTION

1. Field of the Invention

The present invention relates to valve timing regulation device for varying the opening and closing timing of one or both of an air-intake valve and an exhaust valve in response to performance conditions of an internal combustion engine.

2. Description of Related Art

FIG. 22 is a partial cross-sectional view of a conventional valve timing regulation device disclosed for example in JP-A-10-331613. FIG. 23 is an enlarged cross-sectional view of a containing means.

In the figures, 101 is a cylindrical housing which is rotated by the output of the internal combustion engine. The housing 101 has a plurality of shoes 102 on an inner peripheral face. The shoes 102 extend in a radial direction of the housing 101. 103 is a timing sprocket connected to one axial end of the housing 101. The timing sprocket 103 is interlocked with the crankshaft of the internal combustion engine. 104 is a rotor which is housed to rotate relative to the housing 101. The rotor 104 is connected to a camshaft (not shown) which opens and closes the air-intake and exhaust gas valves of the internal combustion. A plurality of vanes 105 which project between mutual vanes 102 project from an outer peripheral face of the rotor 104. 106 is a retarding oil chamber for displacing each vane 105 in a retarding direction. 107 is an advancing oil chamber for displacing each vane 105 in an advancing direction. The retarding oil chamber 106 and the advancing oil chamber 107 are formed between the housing 101 and the rotor 104 by a space having a fan-shaped cross section which is formed between each vane 105 and each shoe 102. A working oil is supplied to the retarding oil chamber 106 and the advancing oil chamber 107.

108 is a seal mounting groove mounted on a tip of the vane 105. 109 is a containing means fitted and retained in the seal mounting groove 108. The containing means 109 comprises a seal member 110 having a spring housing groove 110*a* and a plate spring 111 housed in the spring housing groove 110*a*. The plate spring 111 presses the seal member 110 on the inner peripheral face of the housing 101.

The groove opening side from the groove base of the spring housing groove 110*a* of the seal member 110 has approximately a trapezoid cross sectional shape, the width of which gradually narrows. Thus both inner wall faces of the spring housing groove 110*a* are inclined wall faces 110*b*. On the other hand, the plate spring 111 has a leg piece 111*b* with an expanding shape provided on both edges of the central curved section 111*a*. The central curved section 111*a* has a cross sectional shape approximately in the shape of a circular arc. Before mounting the plate spring 111 with respect to the spring housing groove 110*a*, the plate spring 111 is formed so that the open leg width of the leg piece 111*b* is wider than the width of the opening of the spring housing groove 110*a*.

When assembling the containing means 109, the leg piece 111*b* is pressed into the spring housing groove 110*a* of the seal member 110 while compressing the open leg width of the leg piece 111*b* of the plate spring 111. The pressing of the leg piece 111*b* allows the leg piece 111*b* to be pressed onto and engaged with both inclined wall faces 110*b* of the spring housing groove 110*a*. Furthermore the tip of the leg piece 111*b* abuts with the bottom face of the spring housing groove 110*a*. In this position, the seal member 110 and the plate spring 111 are assembled integrally. A containing means 109 assembled in such a manner is inserted and fitted into the seal mounting groove 108 of the vane 105 during assembly of the housing 101 and the rotor 104. When inserted and fitted, the seal member 110 is pressed onto the inner peripheral face of the housing 101 by the repulsive force of the plate spring 111. Thus the sliding face of the vane 105 and the inner peripheral face of the housing 101 are sealed by the seal member 110.

Since a conventional valve timing regulation device is comprised in the above manner, the leg piece 111*b* must be pressed into the spring housing groove 110*a* of the seal member 110 while compressing the leg piece 111*b* of the plate spring 111 during assembly of the containing means 109. As a result, the problem has arisen that the mounting operation of the plate spring 111 with respect to the seal member 110 is difficult and requires considerable time. Furthermore the mounting of the containing means 109 on the valve timing regulation device is performed by inserting the containing means 109 from one end into the seal mounting groove 108 of the tip of the vane 105 with the rotor 104 fitted into the housing 101. Thus during insertion, it is necessary to deform the plate spring 111 resiliently towards the bottom face of the spring housing groove 110*a*. However the plate spring 111 is fixed with the leg piece 111*b* of the plate spring 111 abutting under pressure with both inclined wall faces 110*b* of the spring housing groove 110*a* and the tip of-the leg piece 111*b* abutting with the bottom face of the spring housing groove 110*a*. As a result, it is difficult to create resilient deformation when insertion into the seal-mounting groove 108 is performed. Thus the problem has arisen that it is difficult to mount the containing means 109 with respect to the valve timing regulation device.

It has been proposed to reduce the spring constant of the plate spring more than necessary in order to solve the above problem. Thus in order to reduce the spring constant, it is necessary to reduce the width of the plate unnecessarily or to reduce the thickness of the plate. However such methods entail the disadvantage that durability of the components can not be maintained and breakage or damage of the plate spring occurs.

Other techniques about the conventional valve timing regulation device are disclosed for example in JP-A-11-30111. Since this valve timing regulation device has the object of preventing positional deviation of the plate spring in a transverse direction, the device does not comprise a detachment prevention structure for the plate spring and the seal member. As a result, when the seal member is assembled into the seal mounting groove, it is necessary to mount the seal member by insertion into the seal mounting groove while retaining the plate spring stored in the seal member mechanically or manually.

This type of mounting operation easily leads to detachment or separation of the plate spring during mounting. Thus for example, when mounting manually, unnecessary mounting time is required. Furthermore when mounting manually, designated mounting tools are required. Also a special detection means is required to detect detachment of the plate spring. In such a manner, unnecessary time is required for the mounting process or preparation for the mounting process. Thus productivity suffers greatly and as a result, the problem of increased costs results.

SUMMARY OF THE INVENTION

The present invention is proposed to solve the above problem and has the object of providing a valve timing regulation device which provides the seal member and plate spring as a pre-assembled unit and which allows easy insertion of both above components between the sliding peripheral faces of a first rotating body and a second rotating body. This arrangement results in improvements in productivity.

The present invention has the further object of providing a valve timing regulation device which allows the further simplification of insertion of the seal member, provided as a pre-assembled unit with the plate spring, between the sliding peripheral faces of the first rotating body and the second rotating body.

The present invention has the further object of providing a valve timing regulation device which allows smooth insertion of the seal member between the sliding peripheral faces of the first rotating body and the second rotating body. After mounting of the seal member and plate spring, this ensures prevention of separation of both above components.

The present invention has the further object of providing a valve timing regulation device which further ensures prevention of separation of the seal member and plate spring after assembly of both these components.

The present invention has the further object of providing a valve timing regulation device which allows smooth fitting of the plate spring into the inner section of the seal member without any resistance and which ensures prevention of separation of the unit comprising the plate spring and seal member after the fitting operation.

The present invention has the further object of providing a valve timing regulation device which allows improvements in mounting productivity of the plate spring with respect to the seal member and allows simple fitting into the inner section of the seal member without interference of the plate spring with the seal member.

The present invention has the further object of providing a valve timing regulation device which prevents deformation of the seal member resulting from deficiencies in strength.

The present invention has the further object of providing a valve timing regulation device which allows simple mounting of the plate spring with respect to the seal member.

The present invention has the further object of providing a valve timing regulation device which allows for self-lubrication of the seal member and thus reduces wear of the seal member. Furthermore by reducing frictional resistance, it is possible to facilitate relative rotation of the first rotating body and the second rotating body.

The present invention has the further object of providing a valve timing regulation device which allows mounting of the plate spring into the inner section of the seal member without interference to the seal member by only applying a bending deformation to the plate spring. After mounting, this ensures that the plate spring does not detach from the inner section of the seal member.

The present invention has the further object of providing a valve timing regulation device which further simplifies mounting of the plate spring with respect to the seal member.

The present invention has the further object of providing a valve timing regulation device which allows simple press-fitting of the spring pressing member into the inner section of the seal member as a guide for the plate spring which is fitted into the inner section of the seal member.

The present invention has the further object of providing a valve timing regulation device which allows simple press-fitting and guiding of the spring pressing member into the inner section of the seal member as a guide for the plate spring which is fitted into the inner section of the seal member. Furthermore it is possible to ensure the integration of the plate spring with respect to the seal member by the spring pressing member without instability.

Furthermore the present invention has the further object of providing a valve timing regulation device which retains a plate spring in a stable manner on an inner section of the seal member, and strongly engages the plate spring resiliently with respect to the seal member. Thus integration of both components can be ensured.

According to a first aspect of the present invention, there is provided a valve timing regulation device comprising: a first rotating body having a plurality of shoes on an inner peripheral face, the first rotation body being rotated by an output of an internal combustion engine; a second rotating body having a plurality of vanes on an outer peripheral face of a boss, the second rotating body stored to rotate relative to an inner section of the first rotating body and connected directly to a cam shaft of a system opening and closing at least one of an air-intake or exhaust valve of the internal combustion engine; a retarding oil pressure chamber and an advancing oil pressure chamber formed between the first rotating body and the second rotating body, and between the shoes and vanes; a seal mounting groove provided on the tip of the shoes and the vanes; a seal member which is indented in cross section and is inserted into the seal mounting groove; a plate spring biasing the seal member in a direction of abutment with an inner peripheral face of the first rotating body or with an outer peripheral face of the boss of the second rotating body, both ends of the plate spring fitted to an inner section of the indentation of the seal member; and a spring fixing means provided on the seal member which suppresses detachment of the plate spring and allows displacement due to elastic deformation of the plate spring.

Here, the seal member may have a tapering face inclined to isolate an end face of the seal member, the tapering face being arranged on at least one end in a longitudinal direction and near the open end of the indented inner section.

The plate spring may comprise a central curved section, and an outwardly bent piece formed on both ends of the central curved section, the outwardly bent piece being fixed with a play between the inner bottom face of the seal member and the spring fixing means.

The plate spring may comprise a central curved section, and an inwardly bent piece formed on both ends of the central curved section, the inwardly bent piece holding the spring fixing means.

The spring fixing means may comprise a cover fitted and engaged with both longitudinal ends on the open end of the indented inner section of the seal member, and covering both ends of the plate spring fitted into the inner section of the seal member.

The valve timing regulation device may further comprise: a fixing projection provided as a spring fixing means on both inner side faces of the seal member; and a notched section having a shape allowing passage of the fixing projection and not interfering with the fixing projection, the notched section being provided on an end face in a transverse direction of the plate spring which biases the seal member, the notched section being retained at a position not aligned with the fixing projection which is a position storing the plate spring with respect to the inner section of the seal member.

The seal member may form a reinforcing cladded section on an inner bottom corner on both longitudinal sides of the seal member.

The spring fixing means may comprise a fixing projection which projects from both inner lateral faces of the seal member and which is opposite to a position sandwiching both edges of the plate spring to create a space with the inner bottom face of the seal member.

The seal member may be formed from a resinous material having self-lubrication properties.

The plate spring may comprise a central curved section, and an outwardly bent piece formed on both ends of the central curved section, the outwardly bent piece being fixed with a play between the inner bottom face of the seal member and the fixing projection, a notched section being formed on an end face in a transverse direction of the outwardly bent piece.

The notched section may be formed on the outwardly bent piece on one end of the plate spring.

The fixing projection may be formed with a hemispherical, circular cross-sectional or elliptical cross-sectional shape.

According to a second aspect of the present invention, there is provided a valve timing regulation device comprising: a first rotating body having a plurality of shoes on an inner peripheral face, the first rotation body being rotated by an output of an internal combustion engine; a second rotating body having a plurality of vanes on an outer peripheral face of a boss, the second rotating body stored to rotate relative to an inner section of the first rotating body and connected directly to a cam shaft of a system opening and closing at least one of an air-intake or exhaust valve of the internal combustion engine; a retard oil pressure chamber and an advancing oil pressure chamber formed between the first rotating body and the second rotating body, and between the shoes and vanes; a seal mounting groove provided on the tip of the shoes and the vanes; a seal member which is indented in cross section and is inserted into the seal mounting groove; opposed engaging projections provided with respect to both inner faces of the seal member; a plate spring fitted into the indented inner section of the seal member, and biasing the seal member in a direction of abutment with an inner peripheral face of the first rotating body or an outer peripheral face of the boss of the second rotating body, a spring pressing member having a hole for fitting onto the central curved section formed on the plate spring, the spring pressing member press-fitted between the inner face of the seal member and the edge of the plate spring and engaging with the fixing projection to cover both ends of the seal member, and the plate spring having a smaller width than the corresponding interval of the fixing projection.

Here, the spring pressing member may be formed as a flat rectangular frame having a hole for fitting the central curved section of the plate spring with a play, a side plate section on both longitudinal sides of the spring pressing member being in contact with both edges of the seal member and being press-fit to the inner section of the inner section of the seal member through the fixing projection.

According to a third aspect of the present invention, there is provided a valve timing regulation device comprising: a first rotating body having a plurality of shoes on an inner peripheral face, the first rotation body being rotated by an output of an internal combustion engine; a second rotating body having a plurality of vanes on an outer peripheral face of a boss, the second rotating body stored to rotate relative to the inner section of the first rotating body and connected directly to a cam shaft of the system opening and closing at least one of an air-intake or exhaust valve of the internal combustion engine; a retarding oil pressure chamber and an advancing oil pressure chamber formed between the first rotating body and the second rotating body, and between the shoes and vanes; a seal mounting groove provided on the tip of the shoes and the vanes; a seal member which is indented in cross section and is inserted into the seal mounting groove; a fixing step for fixing the spring, the fixing step provided on both end faces of the seal member; a plate spring formed in a waveform having a backwardly curved section on both ends of the central curved section, the end of the backwardly curved section resiliently engaging with the fixing step, the stem of each backwardly curved section abutting at two positions on the inner bottom face of the seal member, the plate spring biasing the seal member in a direction of abutment with respect to an outer peripheral face of the boss of the second rotating section or an inner peripheral face of the first rotating section, and spring deformation preventing projections projecting from the inner bottom central section of the seal member and creating a space with the central curved section of the plate spring.

DETAILED DESCRIPTION OF THE PREFERRED EMBODIMENTS

In order to describe the invention in greater detail, the preferred embodiments will be outlined below with reference to the accompanying figures.

Embodiment 1

Figure 1:
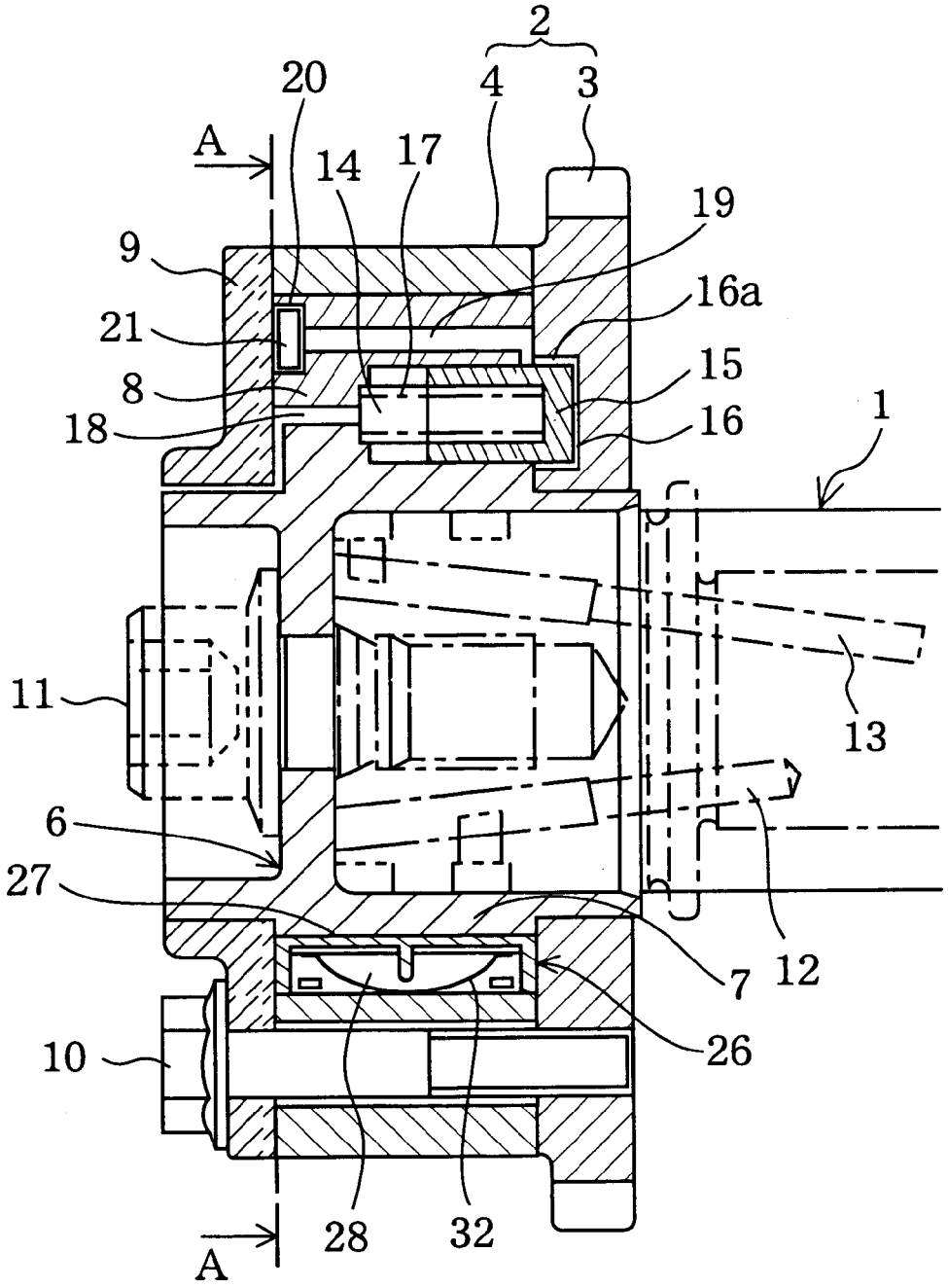
FIG. 1 is a cross sectional view of the valve timing regulation device according to a first embodiment of the present invention.
Figure 2:
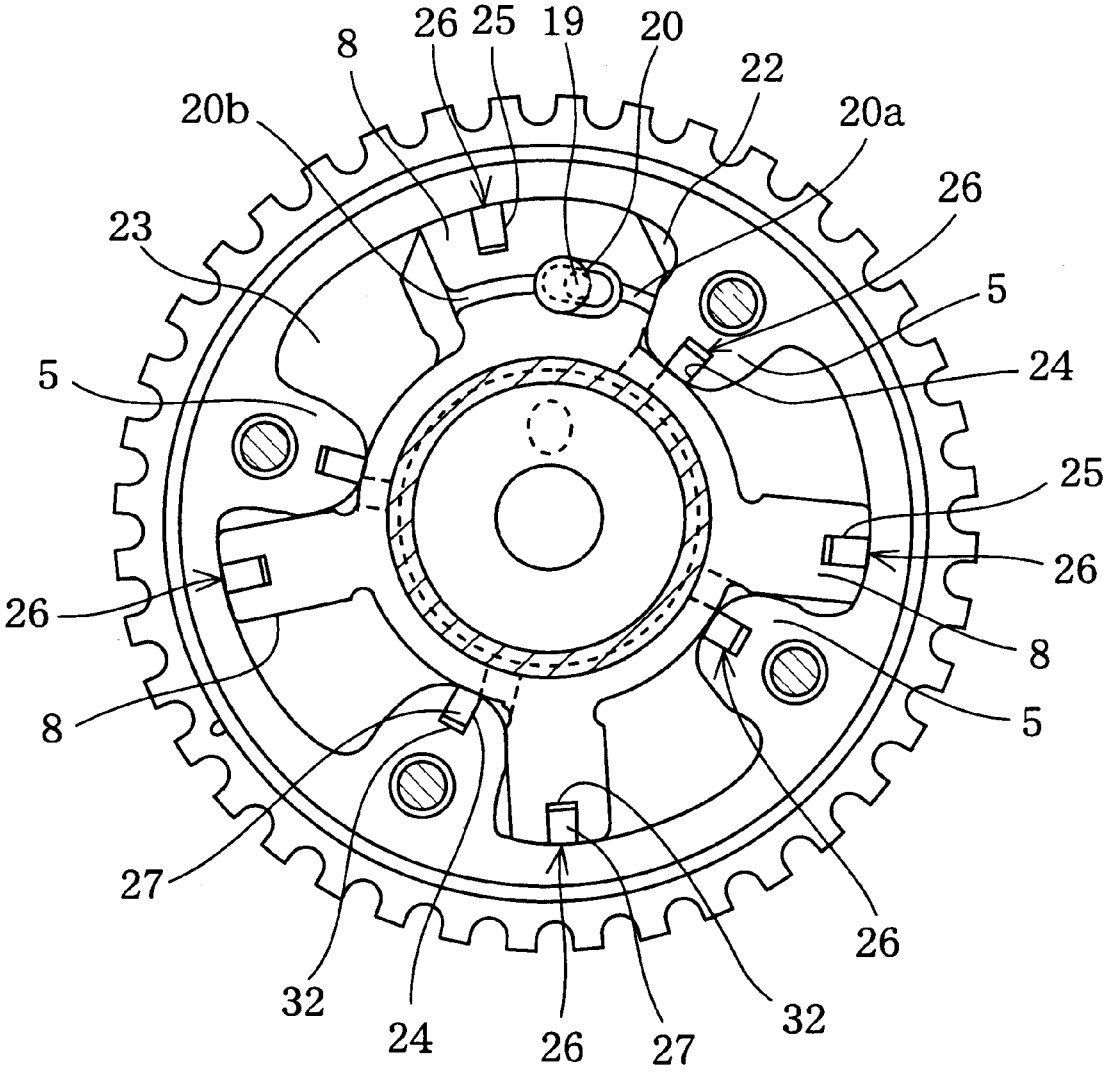
FIG. 2 is a cross sectional along the line A—A in FIG. 1.

FIG. 1 is a cross sectional view of the valve timing regulation device as defined by a first embodiment of the present invention. FIG. 2 is a cross sectional perspective along the line A—A in FIG. 1. In FIG. 1, reference numeral 1 denotes a camshaft of the system for opening and closing the valves of an air-intake and exhaust system for an internal combustion engine. 2 is a first rotating body which is fitted to and retained to rotate freely on the camshaft 1. The first rotating body 2 has a housing structure comprised by a timing sprocket or a timing pulley (hereafter timing rotating body) 3 which inputs a rotational drive force from a crank shaft (not shown) of the internal combustion engine and a case 4 which is mounted on and fixed to one face of the timing rotating body 3. The case 4 is formed by a bore having a cylindrical cross section. A plurality of shoes 5 (refer to FIG. 2) are integrated to extend toward the rotational center of the camshaft 1.

6 is a rotor fixed to the camshaft 1 and housed in the case 4. The rotor 6 comprises a second rotating body which can rotate relative to the first rotating body 2. A plurality of vanes 8 (an equal number to the shoes 5 above) is integrated to extend in a radial direction on a boss 7 which forms the body of the rotor 6 (refer to FIG. 2).

9 is a cover member which is mounted on an end opposite to the timing rotating body 3 in the case 4. 10 is a tie bolt integrating the cover member 9, the case 4 and the timing rotating body 3. Thus the cover member 9 forms a section of the first rotating section 2 as an integrated rotating position on the case 4. 11 is an axial bolt fixing a rotor 6 to an end of the camshaft 1. 12 is a first oil passage which is provided on the rotor 6 and the camshaft 1. The first oil passage 12 communicates with the retarding oil pressure chamber 22 (to be described below). 13 is a second oil passage which is provided on the rotor 6 and the camshaft 1 in the same manner as above. The second oil passage 13 communicates with the advancing oil pressure chamber 23 (to be described below).

14 is a pin hole provided along an axial direction of one vane 8 of the rotor 6. 15 is a lock pin (locking means) which operates in a direction parallel with the rotational axis (the rotational center of the camshaft 1) of the rotor 6 and which is fitted to and retained to slide in the pin hole 14. 16 is an engagement hole which opens onto the sliding face of the vane 8 in the timing rotating body 3 at the integrated rotational position of the case 4. The engagement hole 16 allows engagement and disengagement of the lock pin 15 and is comprised by an indented hole. 16*a* is an oil passage slit formed between the inner face of the engagement hole 16 and the lock pin 15 when engaging the lock pin 15 with respect to the engagement hole 16. 17 is a spring provided as a mechanical biasing means which biases the lock pin 15 on a direction of engagement with the engagement hole 16. 18 is an air release hole provided in the rotor 6. The air release hole 18 opens the housed side of the spring 17 in the pin hole 14 and combines an air hole and a drain passage.

19 denotes an axial oil passage which is provided on a vane 8 which has a lock pin 15 and which communicates with the oil passage slit 16*a*. 20 is a peripheral oil passage which is formed on an end face near the cover member 9 of the vane 8 which has a lock pin 15 in the same manner as above. The peripheral oil passage 20 communicates with the axial oil passage 19. The peripheral oil passage 20, the axial oil passage 19 and the oil passage slit 16*a* introduce an oil pressure into the engagement hole 16 of the lock pin 15 and comprise a lock release oil passage for releasing the locking operation of the lock pin 15 with a hydraulic pressure against the biasing force of the spring 17. 21 is a sliding plate for switching oil passages and is provided in the peripheral oil passage. The function of the sliding plate 21 will be described below.

In FIG. 2, 22 is a retarding oil pressure chamber which displaces each vane 8 in a retarding direction. 23 is an advancing oil pressure chamber for displacing each vane 8 in an advancing direction. The retarding and advancing oil pressure chambers 22, 23 supply a working oil and are formed between the case 4 and the rotor 6 from a fan-shaped space formed between each shoe 5 and each vane 8.

The sliding plate 21 separates the peripheral oil passage 20 into a retarding oil passage 22*a* communicating with the retarding oil pressure chamber 22 and the advancing oil passage 20*b* communicating with the advancing oil pressure chamber 22. The sliding plate 21 displaces towards the advancing oil pressure chamber 23 due to oil pressure from the retarding oil pressure chamber 22 when the oil pressure in the retarding oil pressure chamber 22 is higher than the oil pressure in the advancing oil pressure chamber 23. As a result, the axial oil passage 19 is switched to a position connected to the retarding oil passage 20*a*. The sliding plate 21 displaces towards the retarding oil pressure chamber 12 due to oil pressure from the advancing oil pressure chamber 23 when the oil pressure in the advancing oil pressure chamber 23 is higher than the oil pressure in the retarding oil pressure chamber 22. As a result, the axial oil passage 19 is switched to a position connected to the advancing oil passage 20*b*. Thus the sliding plate 21 has the function of an oil passage switching valve.

24 is a seal mounting groove which is provided on a tip of each shoe 5. 25 is a seal mounting groove provided on the tip of each vane. The seal mounting grooves 24, 25 are formed having an indented shape in cross section. 26 is a containing means mounted onto the respective seal grooves 24, 25. The containing means 26 contains the space between the retarding oil pressure chamber 22 and the advancing oil pressure chamber 23 between the sliding faces of the inner peripheral face of the case 4 with the vane 8 and the sliding faces of the outer peripheral face of the boss 7 with the shoe 5. The detailed structure of the containing means 26 will be described below.

Figure 3:
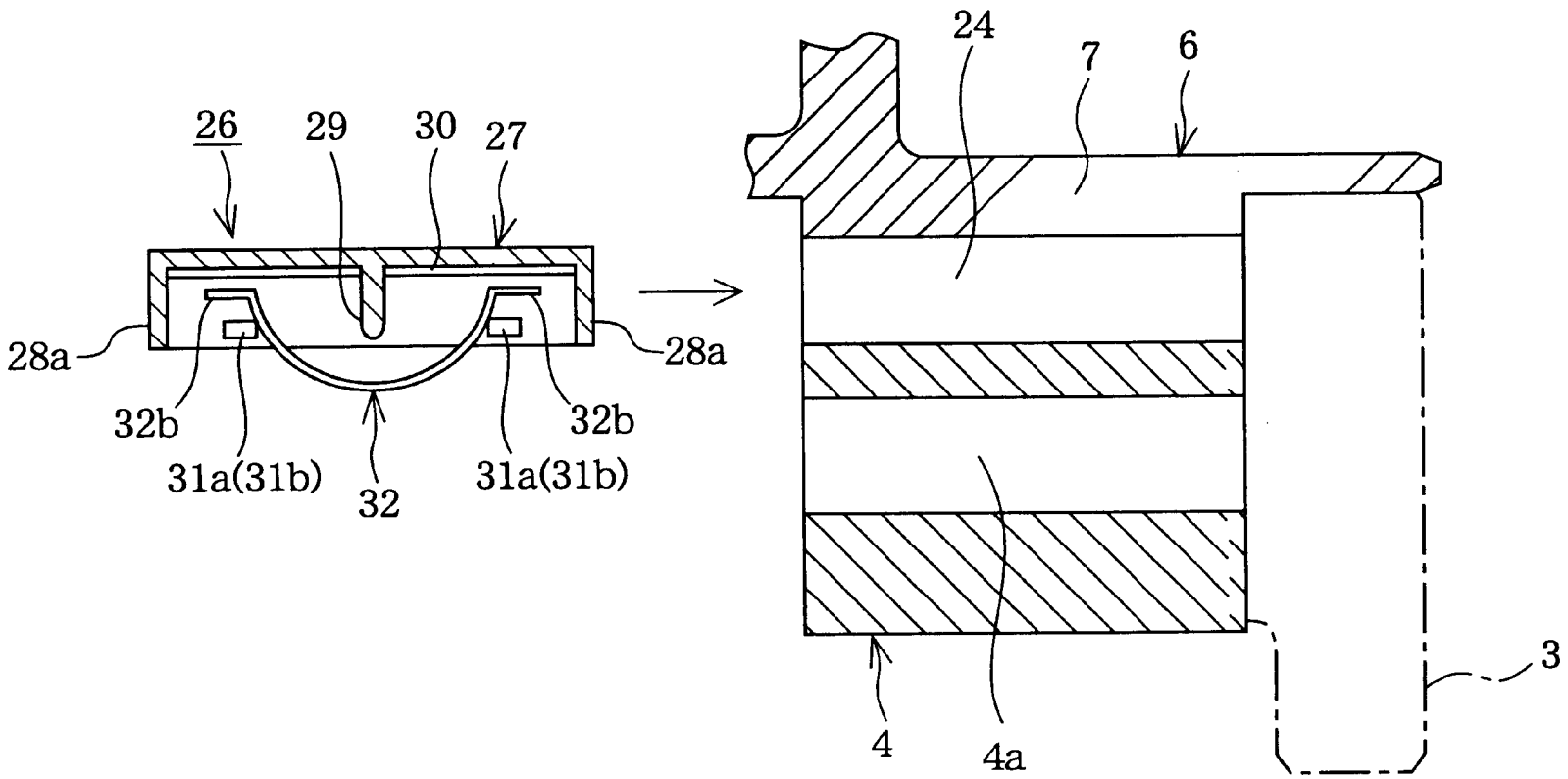
FIG. 3 is an enlarged cross sectional view of the connection between the case and rotor as separated from containing means in FIG. 1.
Figure 4:
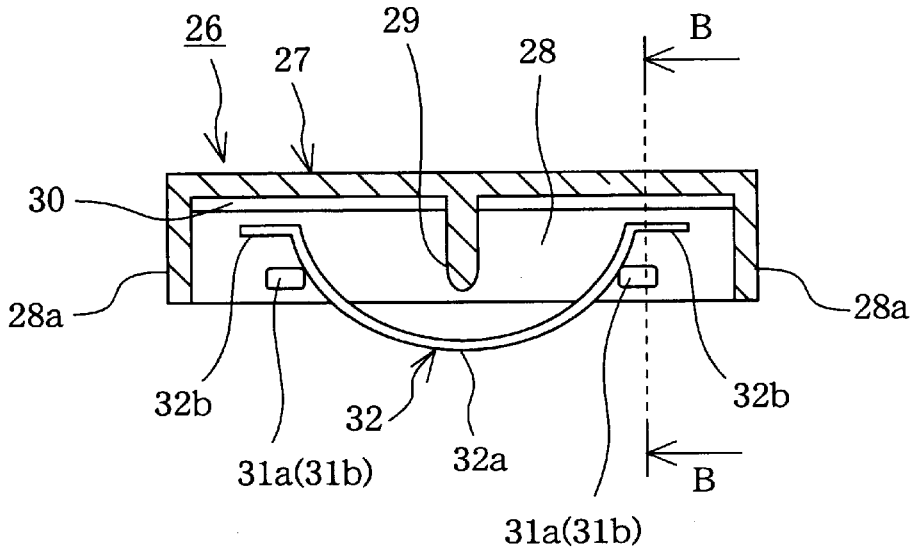
FIG. 4 is a further enlarged cross section view of the containing means of FIG. 3.
Figure 5:
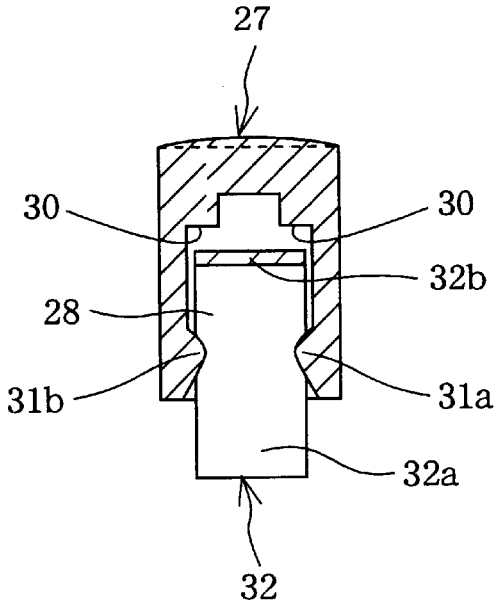
FIG. 5 is an enlarged cross sectional view along the line B—B in FIG. 4.

FIG. 3 is an enlarged cross sectional view of the connection between the case and rotor as separated from containing means in FIG. 1. FIG. 4 is an enlarged cross section view of the containing means in FIG. 3. FIG. 5 is an enlarged cross sectional view along the line B—B in FIG. 4. In the figures, reference numeral 27 denotes a seal member which forms a component of the containing means 26. The seal member 27 is formed in the shape of a box with an indented shape in cross section which has a spring housing groove 28 along a longitudinal direction. 28*a* is an end face which covers both ends of the spring housing groove 28. 29 is a rib-shaped intermediate projection extending from an intermediate bottom section of the spring housing groove 28. The intermediate projection 29 prevents unexpected elastic deformation of the plate spring 32 (discussed below). 30 is a reinforcing cladded section integrated on the inner bottom corner on both longitudinal sides of the spring housing groove 28. The cladded section 30 prevents expanding deformation, across a transverse direction of the spring housing groove, of both longitudinal walls of the seal member 27. 31*a,* 31*b* denote four opposed fixing projections projecting from both inner wall faces towards the open end of the spring housing groove 28. The fixing projections 31*a,* 31*b* engage both transverse edges on both longitudinal ends of the plate spring 32 (described below) in the spring housing groove 28. The fixing projections 31*a,* 31*b* function as a spring fixing means which prevents separation of the plate spring 32 from the spring housing groove 28. Thus the opposed interval of the fixing projections 31*a,* 31*b* is set to be narrower than the width of the plate spring 32.

32 is a plate spring which comprises a containing means 26 by assembly with the seal member 27. The plate spring 32 biases the seal member 27 in a direction of abutment with the inner peripheral face of the case 4 or the outer peripheral face of the boss 7 of the rotor 6. The plate spring 32 comprises a central curved section 32*a* in the shape of a semicircular arc and an outwardly bent piece 32*b* having a pedestal shape which is formed on both ends of the central curved section 32*a*. In FIG. 3, 4*a* is a bolt insertion hole allowing insertion of a tie bolt 10 in FIG. 1.

As discussed above, when the plate spring 32 is mounted in the seal member 27, the side of the plate spring 32 near the outwardly bent piece 32*b* is pressed from the open end into the spring housing groove 28 of the seal member 27. In such a manner, the side of the plate spring 32 near the outwardly bent piece 32*b* is extended through the fixing projections 31*a,* 31*b* of the seal member 27. After the plate spring 32 is pressed through, the outwardly bent piece 32*b* is fixed with a play between the fixing projections 31*a,* 31*b* and the bottom of the spring housing groove 28. In such a manner, the plate spring 32 can be mounted as a unit into the seal member 27 with the outwardly bent piece 32*b* on both ends engaged with the fixing projections 31*a,* 31*b* and the central curved section 32*a* expanded and retained from the open end of the spring housing groove 28.

The length of the plate spring 32 is set to be shorter than the length of the spring housing groove 28 of the seal member 27. As a result, the plate spring 32 which is mounted into the spring housing groove 28 is retained with the end of the outwardly bent piece 32*b* on both ends separated from both end faces 28*a* of the spring housing groove 28. Thus the plate spring 32 can displace due to elastic deformation in the spring housing groove 28.

A seal member 27 with a plate. spring 32 mounted as described above is inserted into each seal mounting groove 24, 25 of the vanes 8 and the shoes 5 when assembling the valve timing regulation device. That is to say, when the valve timing regulation device is assembled, as shown in FIG. 3, the rotor 6 is fitted into the case 4, and the seal mounting grooves 24, 25 function as axial through holes with respectively open ends closed by the inner peripheral faces of the case 4 and the outer peripheral face of the boss section 7 of the rotor 6. Thus the seal member 27 is inserted from one open end into each seal mounting groove 24, 25. When inserted, the plate spring 32 is orientated downwardly as shown in FIG. 3. The plate spring 32 does not detach from the seal member 27 since both edges in proximity to the outwardly bent piece 32*b* of both ends of the plate spring 32 are engaged with the fixing projections 31*a,* 31*b*. Thus the plate spring 32 is inserted into the seal mounting grooves 24, 25 and follows the seal member 27. The central curved section 32*a* of the plate spring 32 slides on the inner bottom face of the seal mounting grooves 24, 25 during insertion and the outwardly bent piece 32*b* on both ends of the plate spring 32 makes contact with the inner bottom face of the seal member 27. Thereafter the central curved section 32*a* undergoes elastic deformation towards the intermediate projection 29 of the seal member 27. This elastic deformation allows the outwardly bent piece 32*b* of both ends of the plate spring 32 to expand while displacing. This expansion reduces frictional resistance between the central curved section 32*a* of the plate spring 32 and the bottom face of the seal mounting grooves 24, 25. As a result, it is possible to perform the mounting operation of the containing means 26 in the valve timing regulation device smoothly and efficiently.

The operation of the invention will be described below.

When the internal combustion engine is operating, a rotational force from the crankshaft (not shown) of the internal combustion engine is transmitted to the timing rotating body 3 and the first rotating body 2 is rotated. At this time, the lock pin 15 is fitted into the engagement hole 16 by a mechanically biasing force of the spring 17 and the first rotating body 2 and the rotor (second rotating body) 6 are locked (refer to FIG. 1). As a result, the first rotating body 2, the rotor 6 and the camshaft 1 rotate together. Thus a cam (not shown) which is integrated on the camshaft 1 opens and closes the air-intake and exhaust gas valves of the internal combustion engine. In this state, oil pressure in response to the operational conditions of the internal combustion engine is supplied from the oil pressure control system to the retarding oil pressure chamber 22, the advancing oil pressure chamber 23 and the engagement hole 16. When the force of the oil pressure force supplied to the engagement hole 16 overcomes the biasing force of the spring 17 with respect to the lock pin 15, the lock pin 15 detaches from the engagement hole 16 due to the oil pressure and the lock of the rotor 6 and the first rotating body 2 is released. The first rotating body 2 and the rotor 6 can rotate relative to one another when the locking operation is released. Thus the opening and closing timing of the air-intake and exhaust gas valves is automatically controlled by the rotation of the rotor 6 due to a pressure differential between the retarding oil pressure chamber 22 and the advancing oil pressure chamber 23.

According to the first embodiment as described above, a spring housing groove 28 which is formed with an indented cross sectional shape along a longitudinal direction on the seal member 27. The seal member 27 is inserted into the seal mounting grooves 24, 25 which is provided on the respective tips of the vanes 8 of the rotor 6 and shoes 5 of the case 4. Fixing projections 31*a,* 31*b* for fixing the spring projects from both inner wall faces of the spring housing groove 28. Both ends of the plate spring 32 are pressed and fitted into the spring housing groove 32 through the fixing projections 31*a,* 31*b*. Thus before assembly of the valve timing regulation device, it is possible to perform simple pre-assembly of the unit comprising seal member 27 and the plate spring 32 by merely pressing and fitting both ends of the plate spring 32 into the spring housing groove 28 of the seal member 27 through the fixing projections 31*a,* 31*b*.

In the first embodiment above, since the length of the plate spring 32 which is retained in the spring housing groove 28 of the seal member 27 is set to be shorter than the length of the spring housing groove 28, both ends of the plate spring 32 fitted into the spring housing groove 28 can engage with the fixing projections 31*a,* 31*b* and can be mounted in a state allowing displacement due to elastic deformation. As a result, during assembly of the valve timing regulation device, it is possible to insert the seal member 27 and the plate spring 32 in an integrated manner with respect to each seal mounting groove 24, 25 of the shoe 5 and the vane 8. During insertion, the central curved section 32*a* of the plate spring 32 deforms elastically due to pressure on the inner bottom face of the seal mounting grooves 24, 25. At this time, both ends of the central curved section 32*a* of the plate spring 32 displace and expand between the inner bottom face of the spring housing groove 28 of the seal member 27 and the fixing projections 31*a*, 31*b*. This displacement reduces the frictional resistance of the bottom face of the seal mounting grooves 24, 25 and the central curved section 32*a* of the plate spring 32. As a result, it is possible to insert the seal member 27 with integrated plate spring 32 smoothly and efficiently into the seal mounting grooves 24, 25.

In accordance with the first embodiment, since the reinforcing cladding section 30 is integrated with both inner bottom corners of the spring housing groove 28 in the seal member 27, when the plate spring 32 is pressed into the spring housing groove 28, it is possible to prevent the expanding deformation of both walls of the spring housing groove 28 from remaining unchanged. Thus it is possible to prevent damage. Furthermore since an outwardly bent piece 32*b* in a pedestal shape is formed on both ends of the central curved section 32*a* of the plate spring 32, it is possible to ensure engagement of the plate spring 32 with the fixing projections 31*a*, 31*b* by the outwardly bent piece 32*b*. Furthermore the effect is obtained that it is possible to store both ends of the plate spring 32 in the spring housing groove 28 in a stable manner by engaging the outwardly bent piece 32*b* slidably on the inner bottom face of the spring housing groove 28. Since an intermediate projection 29 which extends towards an inner side of the central curved section 32*a* of the plate spring 32 projects from the intermediate bottom section of the spring housing groove 28, it is possible to prevent abnormal elastic deformation of the plate spring 32 due to the central curved section 32*a* of the plate spring 32 abutting on the intermediate projection 29 when the central curved section 32*a* of the plate spring 32 is pressured more strongly than required towards the bottom section of the spring housing groove 28.

Embodiment 2

Figure 6:
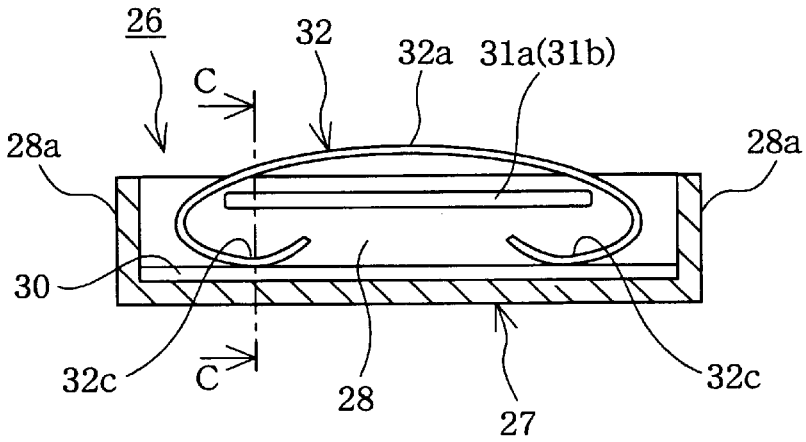
FIG. 6 is a cross sectional view of the containing means according to a second embodiment of the present invention.
Figure 7:
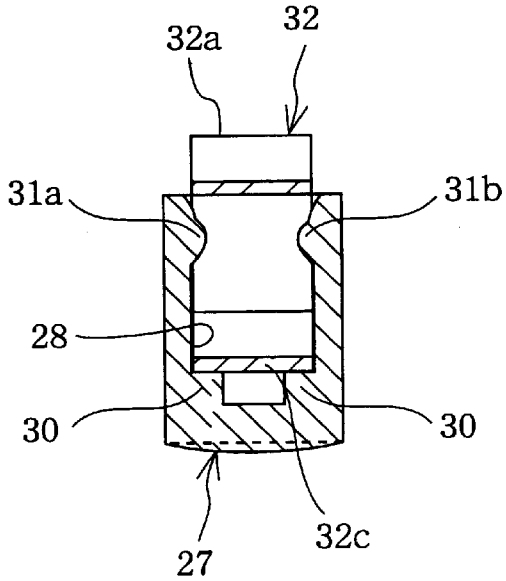
FIG. 7 is an enlarged cross sectional view along the line C—C in FIG. 6.

FIG. 6 is a cross sectional view of the containing means 26 according to a second embodiment of the present invention. FIG. 7 is an enlarged cross sectional view along the line C—C in FIG. 6. Those components which are the same as those described with reference to FIG. 1 to FIG. 5 are denoted by the same reference numerals and further description will be omitted. In embodiment 1, four fixing projections 31*a*, 31*b* project from both inner wall faces of the spring housing groove 28 of the seal member 27. However in the second embodiment, the fixing projections 31*a*, 31*b* project from both inner wall faces of the spring housing groove 28 and are formed in a parallel rail shape extending along a longitudinal direction. The curved inwardly bent piece 32*c* is bent backwardly on both ends of the central curved section 32*a* of the plate spring 32. Both ends of the fixing projections 31*a*, 31*b* are held by the inwardly bent piece 32*c*. This engagement creates a space between the plate spring 32 and both ends 28*a* of the spring housing groove 28 to allow displacement of the plate spring 32.

As described above with reference to the second embodiment, since both ends of the parallel-rail fixing projections 31*a*, 31*b* which project from the spring housing groove 28 of the seal member 27 are held by the inwardly bent piece 32*c* which is bent back onto both ends of the plate spring 32, the effect is obtained that prevention of detachment of the plate spring 32 from the seal member 27 is further ensured. It is possible to prevent abnormal elastic deformation of the plate spring 32, without requiring an intermediate projection 29 as in the first embodiment, due to the fact that both edges of the central curved section 32*a* abut on the upper edge of the parallel rail fixing projections 31*a*, 31*b* when the central curved section 32*a* of the plate spring 32 is pressured more strongly than required towards the bottom section of the spring housing groove 28. In other respects, the effects of the present embodiment are the same as those described with reference with embodiment 1.

Embodiment 3

Figure 8:
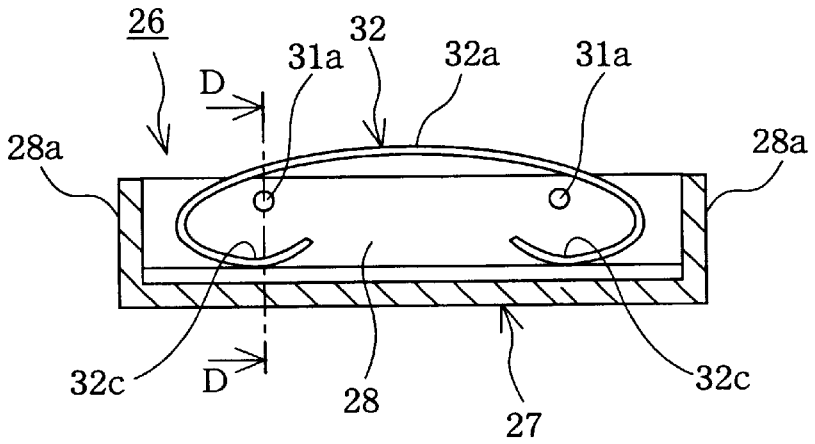
FIG. 8 is a cross sectional view of the containing means according to a third embodiment of the present invention.
Figure 9:
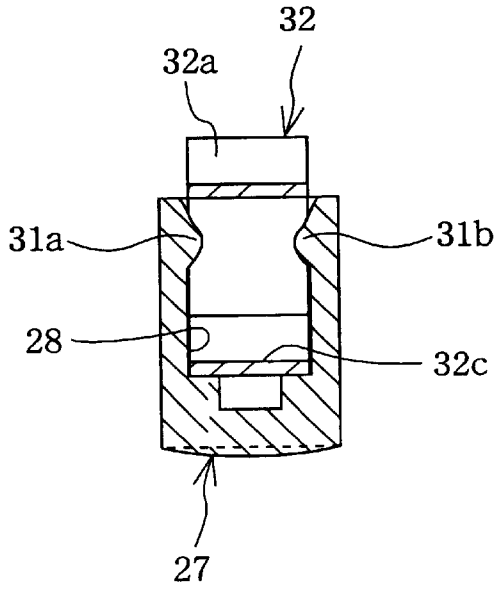
FIG. 9 is an enlarged cross sectional view along the line D—D of FIG. 8.

FIG. 8 is a cross sectional view of the containing means according to a third embodiment of the present invention. FIG. 9 is an enlarged cross sectional view along the line D—D in FIG. 8. Those components which are the same as those described with reference to FIG. 1 to FIG. 7 are denoted by the same reference numerals and further description will be omitted. In the third embodiment, the fixing projections 31*a*, 31*b* in the second embodiment project independently at four opposed positions on both inner wall faces of the spring housing groove 28 of the seal member 27 in the same manner as the first embodiment. Each fixing projection 31*a* , 31*b* is formed respectively as a hemispherical face. The seal member 27 and the plate spring 32 are mounted as a unit by holding these fixing projections 31*a*, 31*b* with the inwardly bent piece 32*c* on both ends of the plate spring 32 as in the second embodiment.

As described above with respect to the third embodiment, the plate spring 32 is passed between the fixing projections 31*a*, 31*b* when the plate spring 32 is pressed into the spring housing groove 28 of the seal member 27 by forming the fixing projections 31*a*, 31*b* in an hemispherical face. Thus it is possible to further facilitate the mounting of the seal member 27 and the plate spring 32.

Embodiment 4

Figure 10:
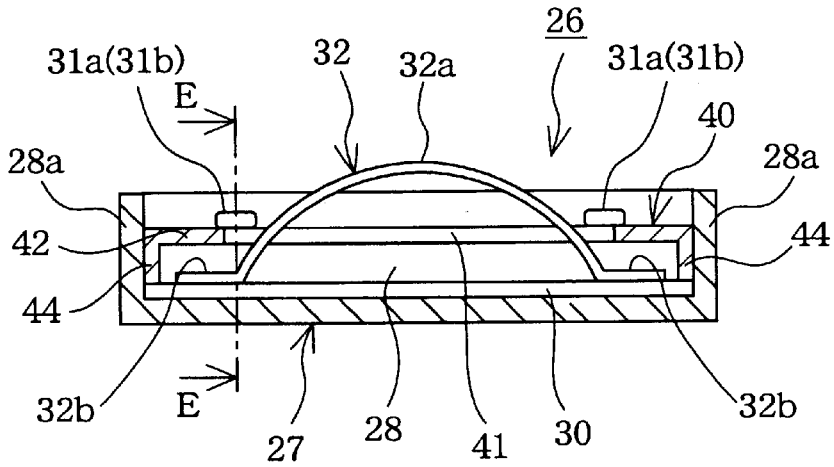
FIG. 10 is a cross sectional view of the containing means according to the fourth embodiment of the present invention.
Figure 11:
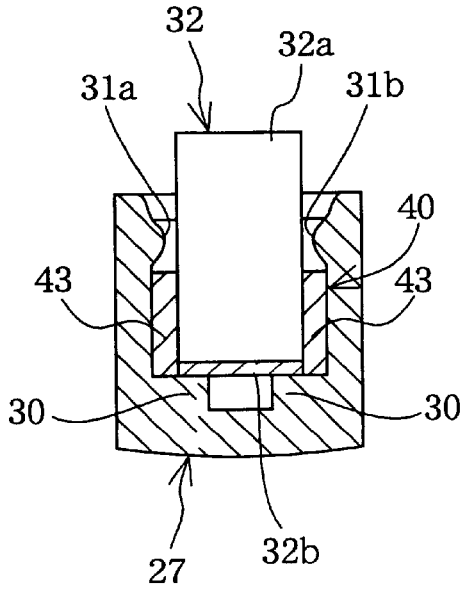
FIG. 11 is an enlarged cross sectional view along the line E—E in FIG. 10.

FIG. 10 is a cross sectional view of the containing means according to the fourth embodiment of the present invention. FIG. 11 is an enlarged cross sectional view along the line E—E in FIG. 10. Those components which are the same as those described with reference to FIG. 1 to FIG. 5 are denoted by the same reference numerals and further description will be omitted. In the figures, 40 is a spring pressing member which is mounted in the spring housing groove 28 of the seal member 27 and which retains the plate spring to displace in the spring housing groove 28. The spring pressing member 40 is formed in the shape of a flat rectangular box which has a hole 41 to allow fitting into the central curved section 32*a* of the plate spring 32. 42 is a plate section of the spring pressing member 40. A hole 41 is provided in the plate section 42. 43 denotes both side walls in a longitudinal direction of the spring pressing member 40. 44 denotes both end walls in a longitudinal direction of the spring pressing member 40. Both side walls 43 and both end walls 44 form peripheral walls of the spring pressing member 40.

The plate spring 32 is formed to have a more narrow width than the opposed interval of the fixing projections 31*a*, 31*b* in the spring housing groove 28. The spring pressing member 40 has a greater width than the opposed interval of the fixing projections 31*a*, 31*b* and furthermore is adapted to have approximately the same groove width as the spring housing groove 28. The length of the hole 41 is less than the length of the plate spring 32. The plate spring 32 is set to have a length so that the end of the outwardly bent piece 32*b* is separated from both end walls 44 of the spring pressing member 40 with the central curved section 32*a* fitted into the hole 41. Other structural elements of the fourth embodiment are the same as the first embodiment.

The assembly of the plate spring 32 in the seal member 27 will be described below.

After fitting both ends of the plate spring 32 near the outwardly bent piece 32*b* into the spring housing groove 28 of the seal member 27, both side walls 43 of the spring pressing member 40 contact both edges of the plate spring 32 and are press-fitted into the spring housing groove 28. The central curved section 32*a* of the plate spring 32 is fitted into the hole 41 of the spring pressing member 40 in the press-fitting step. When the spring pressing member 40 is passed between the fixing projections 31*a,* 31*b* in the spring housing groove 28, the plate section 42 of the spring pressing member 40 is fixed to the fixing projections 31*a,* 31*b*. That is to say, when the spring pressing member 40 is press-fitted as described above, both side walls of the spring housing groove 28 are pressed and expanded until the spring pressing member 40 is passed between the fixing projections 31*a,* 31*b*. When the plate spring 32 is passed between the fixing projections 31*a,* 31*b,* both side walls of the spring housing groove 28 are resiliently restored. In such a manner, the spring pressing member 40 which is housed in the spring housing groove 28 is retained with the plate section 42 fixed to the fixing projections 31*a,* 31*b*. The plate spring 32 is retained with the outwardly bent piece 32*b* on both ends of the plate spring 32 engaged on an inner side of the plate section 42 of the spring pressing member 40. In such a manner, the plate spring 32 can be mounted as a unit with the seal member 27 through the spring pressing member 40.

As described above according to the fourth embodiment, the plate spring 32 which is fitted into the spring housing groove 28 of the seal member 27 is formed with a width which is less than the opposed interval of the fixing projections 31*a,* 31*b* which project from an inner wall of the spring housing groove 28. Thus it is possible to fit the plate spring 32 into the spring housing groove 28 in a simple manner without any resistance. Furthermore the effect is obtained that it is possible to ensure prevention of detachment of the plate spring 32 which is fitted into the spring housing groove 28 due to the spring pressing member 40. That is to say, the spring pressing member 40 is formed as a flat rectangular frame in a box shape which has a hole 41 in order to fit into the central curved section 32*a* the plate spring 32. Both side walls (side plates) 43 come into contact with both edges of the plate spring 32 and are press-fitted into the spring housing groove 28. Thus it is possible to press-fit the spring pressing member 40 into the spring housing groove 28 using the plate spring 32 as a guide. As a result, it is possible to facilitate the press-fitting operation. The plate section 42 of the spring pressing member 40 which is press-fitted into the spring housing groove 28 is fixed to the fixing projections 31*a,* 31*b* and covers both ends of the plate spring 32. Both side walls 43 of the spring pressing member 40 are in contact with both side edges of the plate spring 32. Thus the effect is obtained that it is possible to ensure mounting of the plate spring 32 into the seal member 27 so that the plate spring 32 does not displace in a transverse direction in the spring housing groove 28 and the plate spring 32 does not detach.

Thus according to the fourth embodiment, the plate spring 32 which is mounted into the spring housing groove 28 of the seal member 27 by the spring pressing member 40 as described above is adapted so that the outwardly bent piece 32*b* is separated from both end walls 44 of the spring pressing member 40 to allow displacement due to elastic deformation. As a result, when the valve timing regulating device is assembled, the central curved section 32*a* of the plate spring 32 is deformed elastically by being pressed by the inner bottom face of the seal mounting groove 24, 25, when the seal member 27 is inserted into each seal mounting groove 24, 25 of the vane 8 and the shoe shown in FIG. 1 or FIG. 2. In this manner, frictional resistance between the central curved section 32*a* of the plate spring 32 and the bottom face of the seal mounting grooves 24, 25 is reduced. As a result, it is possible to insert the seal member 27 which is integrated with the plate spring 32 into the seal mounting grooves 24, 25 smoothly and efficiently.

Embodiment 5

Figure 12:
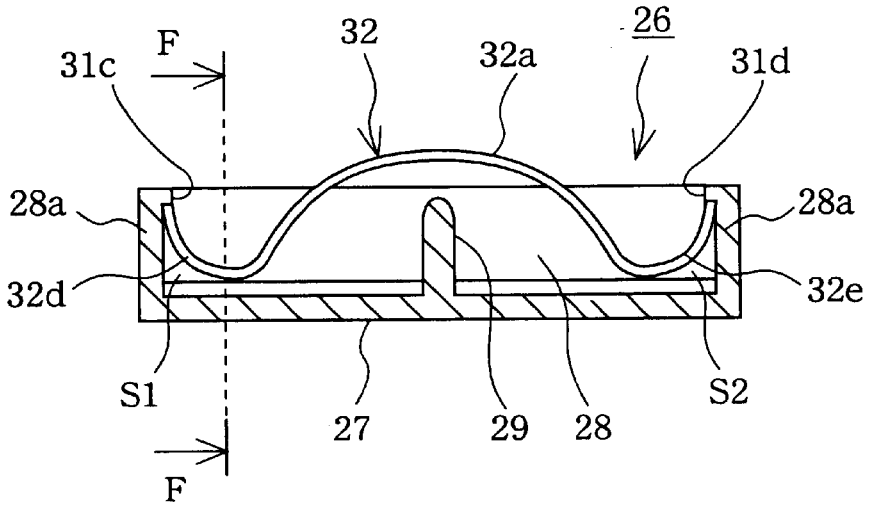
FIG. 12 is a cross sectional view of the containing means according to a fifth embodiment of the present invention.
Figure 13:
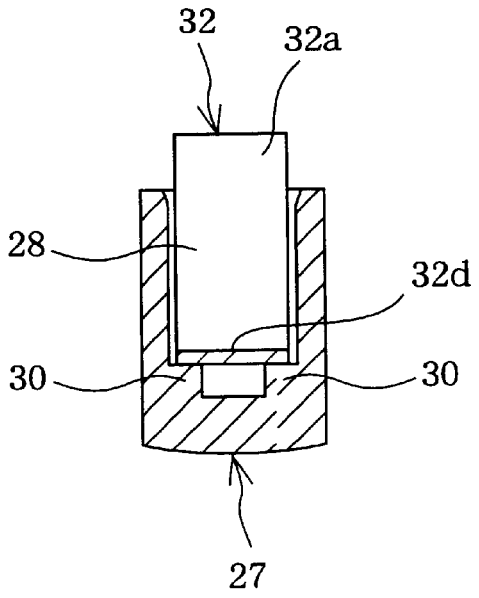
FIG. 13 is an enlarged cross sectional view along the line F—F of FIG. 12.

FIG. 12 is a cross sectional view of the containing means according to a fifth embodiment of the present invention. FIG. 13 is an enlarged cross sectional view along the line F—F of FIG. 12. Those components which are the same as those described with reference to FIG. 1 to FIG. 5 are denoted by the same reference numerals and further description will be omitted. In the figures, 31*c,* 31*d* is a fixing step which is provided on an inner side of both end walls 28*a* of the seal member 27. These fixing steps 31*c,* 31*d* are comprised by fixing projections projecting from the inner side of the open end of both end walls 28*a*. 32*d,* 32*e* are outwardly back-curved sections formed on both ends of the central curved section 32*a* of the plate spring 32. The fixing step 31*c,* 31*d* may be comprised by a fixed groove formed on an inner wall face of both end walls 28*a,* that is to say, by a component which allows resilient engagement of both ends of the plate spring 32.

That is to say, in embodiment 5, a plate spring 32 is formed in a waveform shape which has backwardly curved sections 32*d,* 32*e* on both ends of the central curved section 32*a* is formed. The backwardly curved sections 32*d,* 32*e* on both ends are fitted into the spring housing groove 28 of the seal member 27 and abut with the outer curved face forming the stem of the backwardly curved sections 32*d,* 32*e* on the groove bottom of the spring housing groove 28. A plate spring 32 is mounted into the seal member 27 by resilient engagement of the end of the backwardly curved section 32*d,* 32*e* on the inner side of the fixing steps 31*c,* 31*d*. When mounted, the central curved section 32*a* of the plate spring 32 can abut with the intermediate projection 29 of the seal member 27 during to elastic deformation. S1, S2 are spaces generated between both end walls 28*a* of the seal member 27 and the backwardly curved sections 32*d,* 32*e* of the plate spring 32.

According to the fifth embodiment, the plate spring is formed in a waveform shape and fixing steps 31*c,* 31*d* are formed to perform resilient engagement with the end of the backwardly curved sections 32*d,* 32*e* of the plate spring 32. The fixing steps 31*c,* 31*d* are formed on an inner side of both end walls 28*a* of the seal member 27. The stem of the backwardly curved sections 32*d,* 32*e* abuts with the bottom of the groove of the spring housing groove 28 of the seal member 27. In this position, the end of the backwardly curved sections 32*d,* 32*e* undergoes resilient engagement with the fixing steps 31*c,* 31*d*. This structure allows abutment of two positions of the backwardly curved sections 32*d,* 32*e* on both ends of the plate spring 32 with the bottom of the groove of the spring housing groove 28 of the seal member 27, when the plate spring 32 is mounted with respect to the seal member 27. In this way, it is possible to retain the plate spring 32 in a stable manner in the spring housing groove 28. As a result, it is possible to perform simple engagement of the respective ends of the backwardly curved sections 32*d,* 32*e* with the fixing steps 31*c* 31*d*. Thus it is possible to further simplify the mounting of the plate spring 32 into the seal member 27.

According to the fifth embodiment, spaces S1, S2 are generated between both end walls 28*a* of the seal member 27 and the backwardly curved sections 32*d*, 32*e* of the plate spring 32 with the plate spring mounted into the seal member 27 as described above. These spaces S1, S2 comprise relief spaces during elastic deformation resulting from the central curved section 32*a* of the plate spring 32 being pressed towards the bottom of the spring housing groove 28. As a result, it is possible to insert the seal member 27, which is integrated with the plate spring 32, in a simple manner into the seal mounting grooves 24, 25 of the valve timing regulation device. (refer to FIG. 2, FIG. 3). Furthermore when the central curved section 32*a* of the plate spring 32 is pressed above a fixed pressure in the direction of the bottom of the spring housing groove 28, the central curved section 32*a* abuts with the intermediate projection 29 of the seal member 27. As a result, it is possible to prevent abnormal deformation of the plate spring 32.

Embodiment 6

Figure 14:
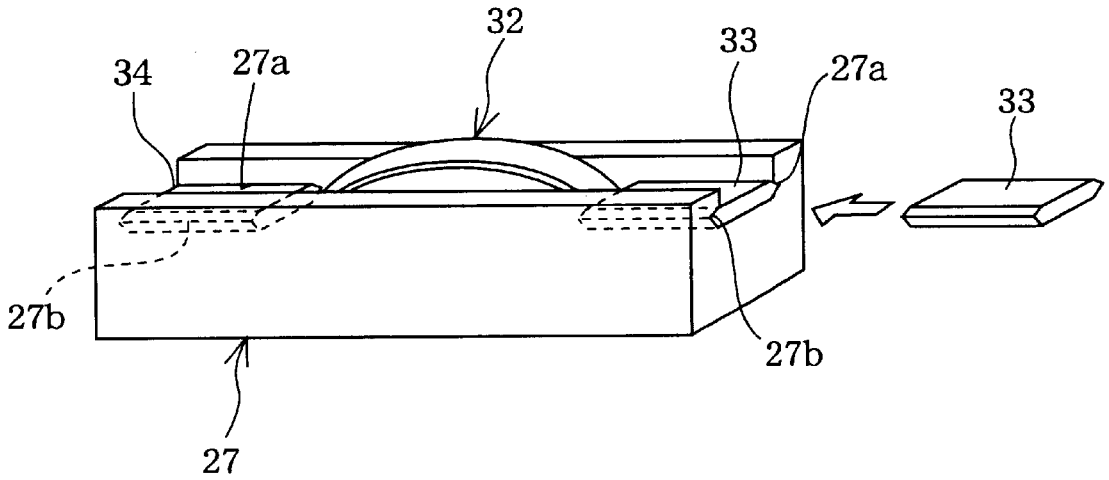
FIG. 14 is a perspective view of the containing means according to a sixth embodiment of the present invention.
Figure 15:
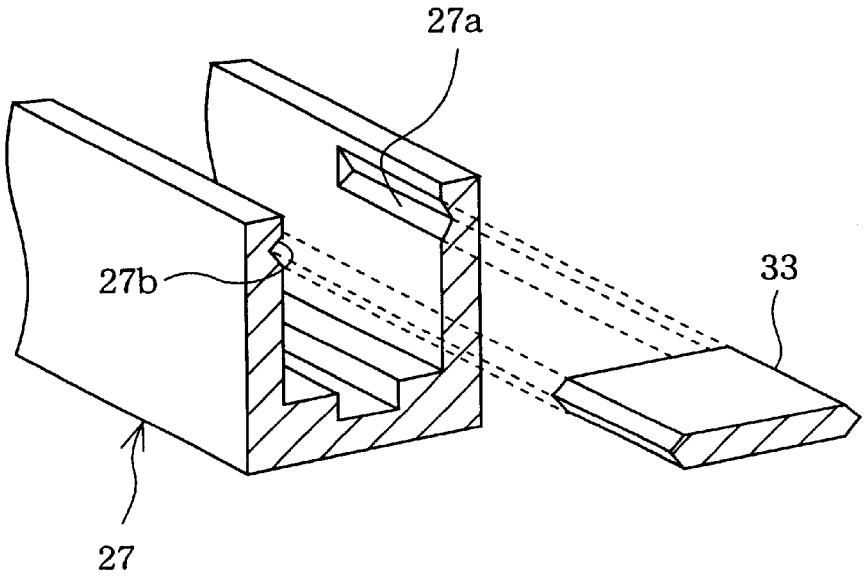
FIG. 15 is a partial enlarged cross-sectional perspective view showing the main components of FIG. 14.

FIG. 14 is a perspective view of the containing means according to a sixth embodiment of the present invention. FIG. 15 is a partial enlarged cross-sectional perspective view showing the main components of FIG. 14. Those components which are the same as those described with reference to FIG. 1 to FIG. 13 are denoted by the same reference numerals and further description will be omitted. In the figures, 27*a*, 27*b* denote cover engagement grooves formed opposite the inner face of both side walls in the open end of the spring housing groove 28 of the seal member 27. 33, 34 denote covers which are fitting into and engage with the cover engagement grooves 27*a*, 27*b*. The covers 33, 34 represent a spring detachment prevention means for preventing the detachment of the plate spring 32 and cover both ends of the plate spring 32 which is fitting into the spring housing groove 28 of the seal member 27. That is to say, in the sixth embodiment, the fixing projections 31*a*, 31*b* described from the first embodiment to the third embodiment, the fixing projections 31*a*, 31*b* and spring pressing member 40 described in the fourth embodiment and the fixing steps 31*c*, 31*d* of the fifth embodiment are respectively substituted by the covers 33, 34. Both ends of the plate spring 32 which are fitted into the spring housing groove 28 are adapted to be covered by fitting and engaging the covers 33, 34 into the cover engaging grooves 27*a*, 27*b*.

As shown above with reference to the sixth embodiment, before mounting the covers 33, 34, the plate spring 32 can be fitted into the spring housing groove 28 of the seal member 27 without any resistance. After the plate spring 32 is fitted, it is possible to mount the plate spring 32 in the seal member 27 simply and efficiently by merely fitting and engaging the covers 33, 34 with the cover engagement grooves 27*a*, 27*b* from the outer direction of the both ends of the seal member 27.

Embodiment 7

Figure 16:
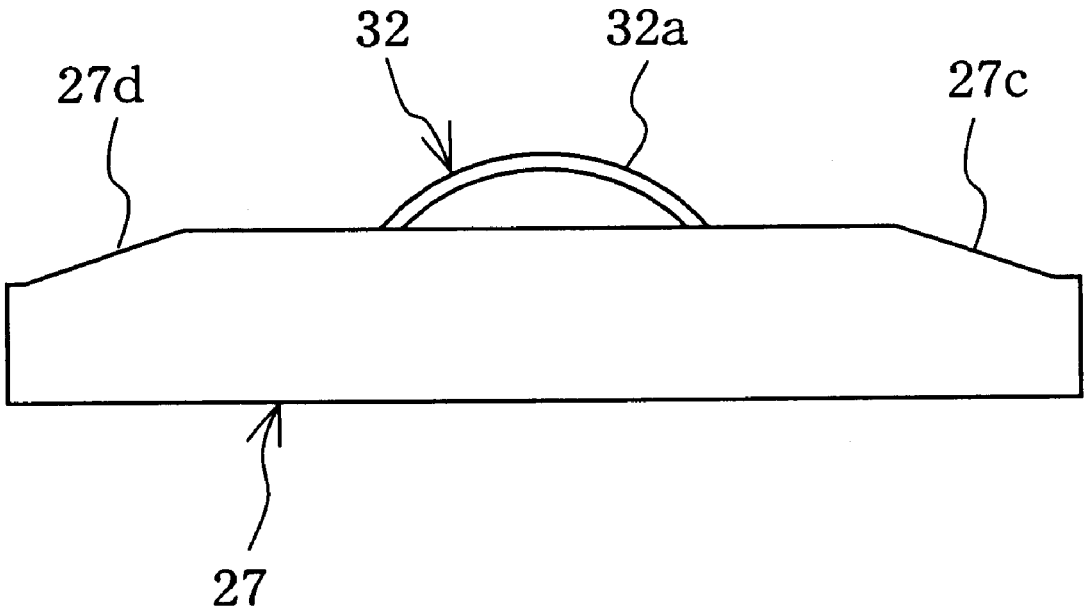
FIG. 16 is a lateral view of the containing means according to a seventh embodiment of the present invention.

FIG. 16 is a perspective view of the containing means according to a seventh embodiment of the present invention. In the figure, 27*c*, 27*d* denote tapering faces formed on the open end of the spring housing groove 28. The tapering faces comprise both end sections in a longitudinal direction of the seal member 27. The tapering faces 27*c*, 27*d* incline towards a direction separating the open ends of the spring housing groove 32 at both end sections of the seal member 27. That is to say, in the seventh embodiment, tapering faces 27*c*, 27*d* are formed at both end sections in a longitudinal direction at the open ends of the spring housing groove 28 of the seal member of the first to the fifth embodiment. Either one of the tapering faces 27*c*, 27*d* may be also formed on one end section in a longitudinal direction of the seal member 27.

According to the seventh embodiment, since tapering faces 27*c*, 27*d* are formed on both end sections in a longitudinal direction of the seal member 27 as described above, the insertion of the seal member 27 into the seal mounting grooves 24, 25 of the valve timing regulation device is simplified (refer to FIG. 2, FIG. 3). As a result, it is possible to further improve the mounting operation of the seal member 27 which is integrated with the plate spring 32 into the valve timing control device.

Embodiment 8

Figure 17:
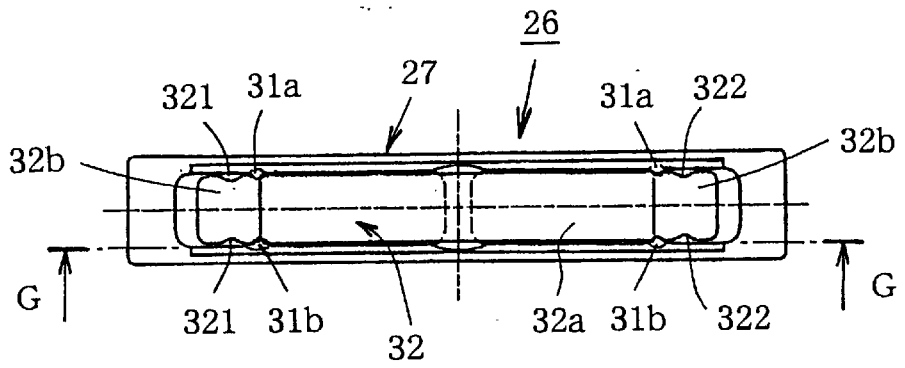
FIG. 17 is a plan view of the containing means 26 according to an eighth embodiment of the present invention.
Figure 18:
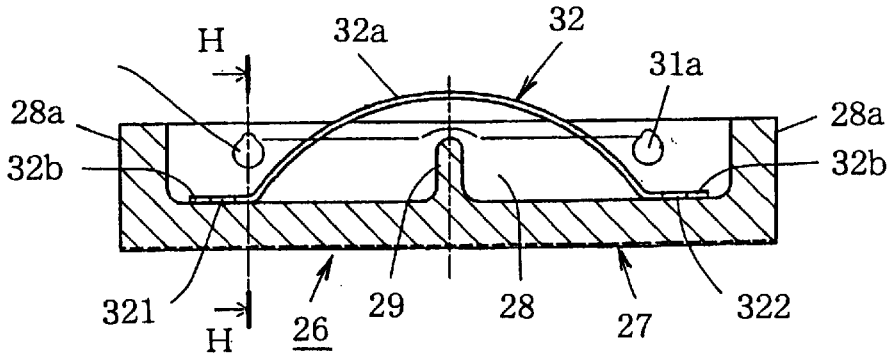
FIG. 18 is a cross sectional view along the line G—G in FIG. 17.
Figure 19:
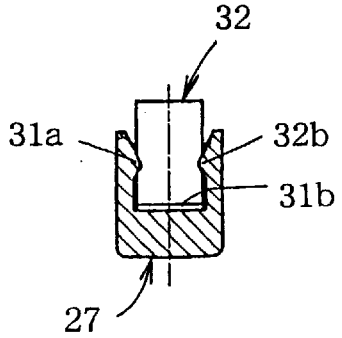
FIG. 19 is a cross sectional view along the line H—H in FIG. 18.

FIG. 17 is a plan view of the containing means according to an eighth embodiment of the present invention. FIG. 18 is a cross sectional view along the line G—G in FIG. 17. FIG. 19 is a cross sectional view along the line H—H in FIG. 18. Those components which are the same as those described with reference to FIG. 1 to FIG. 5 are denoted by the same reference numerals and further description will be omitted. In the figures, reference numerals 321, 322 denote notched sections on both the right and left side which are formed on a transverse end face of the outwardly bent piece 32*b* of both ends of the plate spring 32. The notched sections 321, 322 are formed in a shape allowing passage and fitting of the fixing projections 31*a*, 31*b* without interfering with the fixing projections 31*a*, 31*b* of the seal member 27, when the plate spring 32 is mounted into the seal member 27.

To describe the above in further detail, when the plate spring 32 is in a natural condition, the notched sections 321, 322 on both ends of the plate spring 32 are set to have a larger interval than the interval between one end of the fixing projections 31*a*, 31*b* and the other end of the fixing projections 31*a*, 31*b* in a longitudinal direction of the seal member 27. Thus the intervals between the notched sections 321, 322 is an interval which is approximately equal to the interval between the fixing projections 31*a*, 31*b* on one end and the fixing projections 31*a*, 31*b* on the other end. This is achieved by adapting the notched sections 321, 322 to allow fitting into the fixing projections 31*a*, 31*b* by bending (elastic deformation) the central curved section 32*a* of the plate spring 32.

That is to say, in the eighth embodiment, notched sections 321, 322 are provided with a shape which allows passage of the fixing projections 31*a*, 31*b* without interfering with the fixing projections 31*a*, 31*b* of the seal member 27. The notched sections 321, 322 are provided on the transverse end face of the outwardly bent piece 32*b* of both ends of the plate spring 32 in the containing means 26 in the first embodiment. In such a manner, the notched sections 321, 322 are adapted to be retained at a position which is not aligned with the fixing projections 31*a*, 31*b* by the resilient return force of the plate spring 32 which is a position which mounts the plate spring 32 with respect to an inner section of the seal member 27.

The above operation will be described below.

Figure 20A:
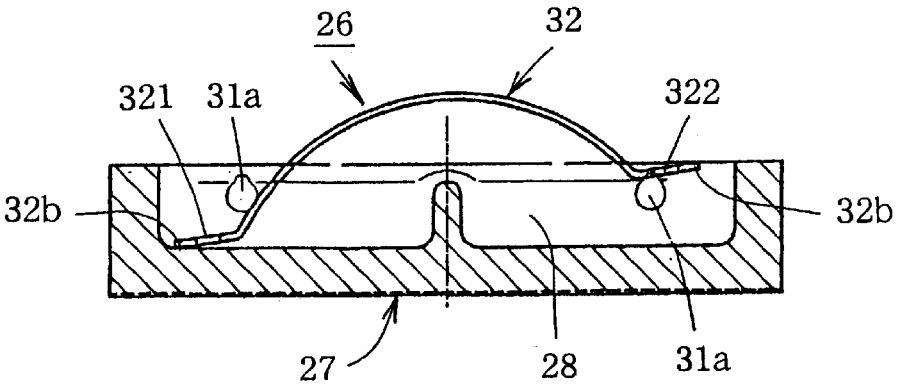
FIG. 20(*a*) to FIG. 20(*c*) are a diagram of the assembly process of the containing means according to an eighth embodiment of the present invention.
Figure 20B:
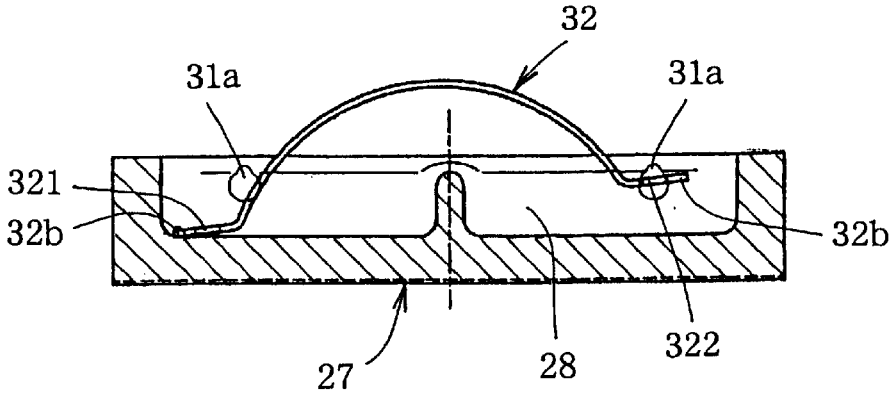
Figure 20C:
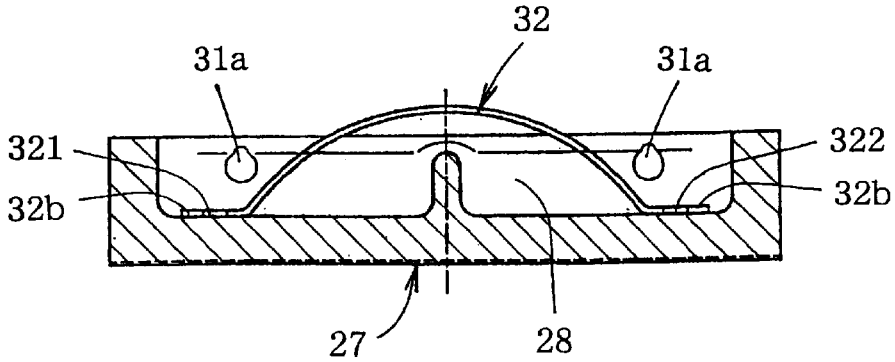
Figure 21A:
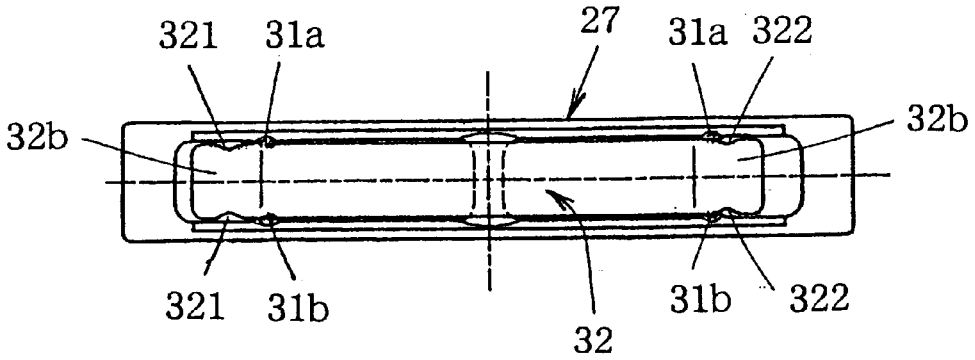
FIG. 21(*a*) to FIG. 21(*c*) are plan figures of FIG. 20(*a*) to FIG. 20(*c*).
Figure 21B:
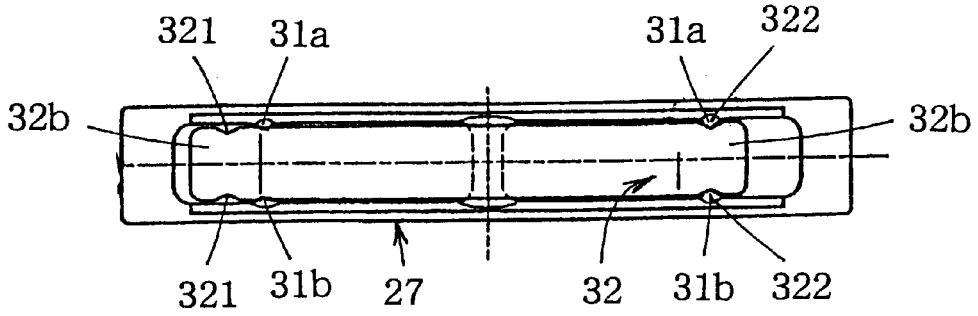
Figure 21C:
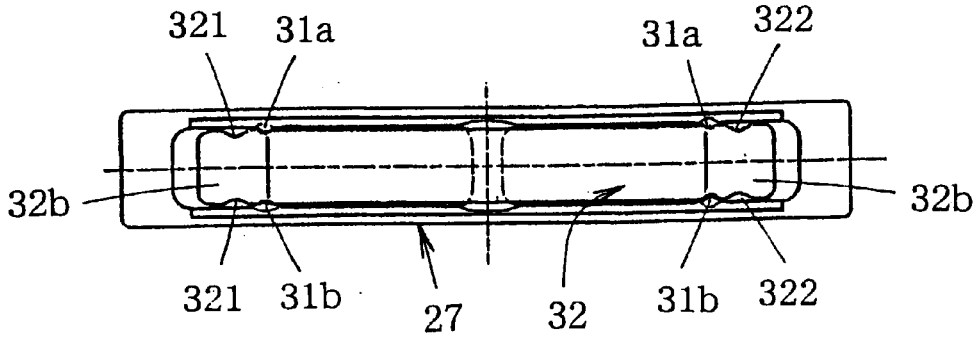
Figure 22:
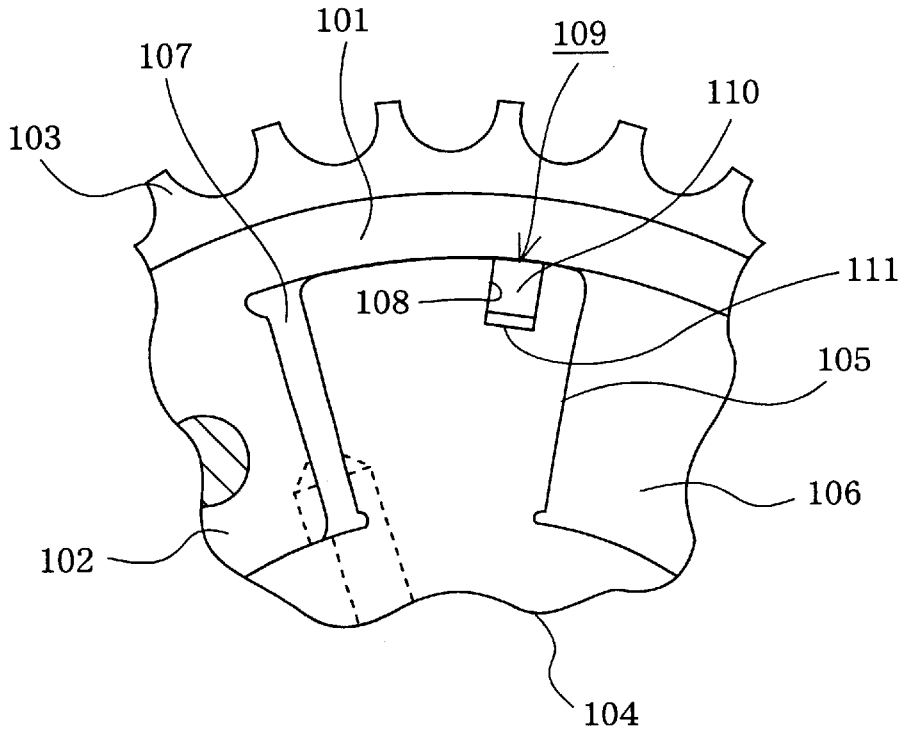
FIG.22 (PRIOR ART)
FIG. 22 is a partial cross-sectional view of a conventional valve timing regulation device disclosed for example in JP-A-10-331613.
Figure 23:
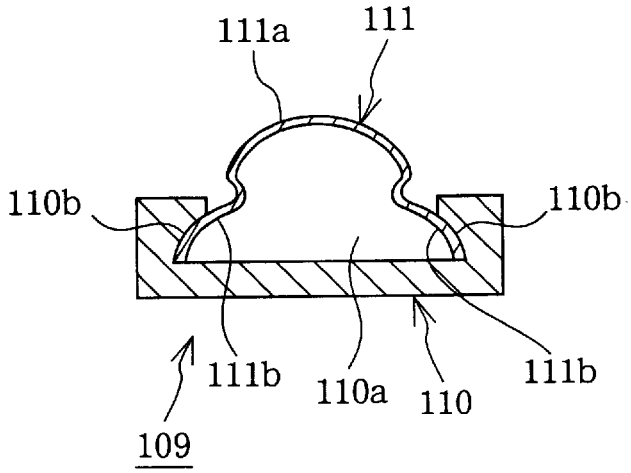
FIG.23 (PRIOR ART)
FIG. 23 is an enlarged cross-sectional view of a containing means as shown in FIG. 17.

FIG. 20 is a diagram of assembly steps of the containing means 26 according to an eighth embodiment of the present invention. FIG. 21 is a plan view of FIG. 20. When the plate spring 32 is assembled into the seal member 27, firstly as shown in FIG. 20(*a*), the outwardly bent piece 32*b* on one end of the plate spring 32 is inserted between the inner bottom face of the seal member 27 and the fixing projections 31*a*, 31*b* towards a longitudinal end of the seal member 27 by inclining the plate spring 32. At this time, the tip in the direction of insertion of the outwardly bent piece 32*b* projects and abuts with the inner bottom section of the seal member 27.

Thereafter the notched section 322 which is formed on the outwardly bent piece 32*b* on the other end of the plate spring 32 is deformed to a position which is aligned opposite the fixing projections 31*a* 31*b* on a longitudinal end of the seal member 27 as shown in FIG. 20(*b*) by deforming the central curved section 32*a* of the plate spring 32 in a direction of insertion with respect to the outwardly bent piece 32*b* with the abutting section acting as a fulcrum. The notched section 322 is fitting with respect to the fixing projections 31*a,* 31*b.*

After the notched section 322 passes through, as shown in FIG. 20(*c*), when the central curved section 32*a* of the plate spring 32 is resiliently restored to a natural state, the outwardly bent piece 32*b* on both ends of the plate spring 32 is engaged with a play between the inner bottom face of the seal member 27 and each fixing projection 31*a,* 31*b.* When engaged with a play in such a manner, the notched sections 321, 322 of the outwardly bent piece 32*b* on both ends of the plate spring 32 are retained at a position which is not aligned with each fixing projections 31*a,* 31*b.* As a result, the outwardly bent piece 32*b* on both ends of the plate spring 32 is engaged on each fixing projections 31*a,* 31*b* with respect to a direction of detachment of the plate spring 32 from the inner section of the seal member 27. This completes the mounting of the plate spring 32 with respect to the seal member 27.

As described above with reference to the eighth embodiment, notched sections 321, 322 are provided with a shape which allows passage of fixing projections 31*a,* 31*b* without interfering with the fixing projections 31*a,* 31*b* of the seal member 27. The notched sections 321, 322 are provided on a transverse end face of the outwardly bent piece 32*b* of both end sections of the plate spring 32. The notched sections 321, 322 are adapted to displace to a position which is aligned opposite the fixing projections 31*a,* 31*b* by deforming the central curved section 32*a* of the plate spring 32 in a direction in which the outwardly bent pieces 32*b* on both ends of the central curved section 32*a* approach one another. Such an arrangement allows interference with the fixing projections 31*a,* 31*b* by the plate spring 32 to be avoided by the notched sections 321, 322 when the plate spring 32 is mounted into the seal member 27. As a result, the top of the fixing projections 31*a,* 31*b* is not cut by the. side edge of the plate spring 32 as a result of such interference and thus it is possible to prevent the production of fragments or plastic deformation of the plate spring 32.

When fragments are generated, the filter of the oil pressure supply system of the valve timing regulation device may be clogged and thus the possibility exists of damage to the oil pressure apparatus of the internal combustion engine. As a result, after the plate spring 32 is mounted into the seal member 27, it is necessary to remove fragments by an air blow or the like. However as described with reference to the eighth embodiment, such an operation is no longer required. Furthermore when the plate spring 32 undergoes plastic deformation, the biasing force of the seal member 27 due to the plate spring 32 is weakened when the seal member 27 mounted onto the plate spring 32 is mounted into the valve timing regulation device. The seal between the advancing oil pressure chamber 22 and the retarding oil pressure chamber 23 may be damaged and the performance of the valve timing regulating device may deteriorate. However as defined by the eighth embodiment, the effect is obtained that it is possible to prevent plastic deformation of the plate spring 32 as described above.

According to the eighth embodiment, when the plate spring 32 is mounted into the inner section of the seal member 27, as shown above, the mounting of the plate spring 32 can be simply and efficiently performed and the assembly operation improved by passing the fixing projections 31*a,* 31*b* without the notched sections 321, 322 of the plate spring 32 interfering with the fixing projections 31*a,* 31*b.*

When the plate spring 32 is mounted, the outwardly bent piece 32*b* on one end of the plate spring 32 is inserted between the inner bottom face of the seal member 27 and the fixing projections 31*a,* 31*b* towards one longitudinal end of the seal member 27 by inclining the plate spring 32. The tip in the direction of insertion of the outwardly bent piece 32*b* projects and abuts with the inner bottom face of the seal member 27. Thereafter the notched section 322 which is provided on the outward bent piece 32*b* on the other end of the plate spring 32 is simply displaced to a position which is aligned opposite the fixing projections 31*a* 31*b* towards the other longitudinal end of the seal member 27. The notched section 322 is displaced by deforming the central curved section 32*a* of the plate spring 32 with a slight force which does not result in plastic deformation with the point of abutment acting as a fulcrum. Thus the notched section 322 can be passed through and fitted easily with respect to the fixing projections 31*a,* 31*b* and it is possible to further simplify the operation of mounting the plate spring 32.

According to the eighth embodiment, the notched sections 321, 322 are adapted to be retained at a position which is not aligned with the fixing projections 31*a,* 31*b* by the resilient return force of the plate spring 32 which is a position which mounts and stores the plate spring 32 with respect to the inner section of the seal member 27. Furthermore the plate spring 32 after mounting into the seal member 27 does not detach from the inner section of the seal member 27 as the outwardly bent piece 32*b* on both ends of the plate spring 32 is retained at a position allowing engagement with the fixing projections 31*a,* 31*b* at a inner section of the seal member 27. Thus the effect is obtained that it is possible to perform simple assembly of the unit comprising the seal member 27 and the plate spring 32 into the valve timing regulation device.

Embodiment 9

According to the eighth embodiment, notched sections 321, 322 on transverse end faces are respectively provided on the outward bent piece 32*b* of both ends of the plate spring 32. However a notched section 322 on a transverse end face may be provided only on the outwardly bent section 32*b* of one end of the plate spring 32. When the plate spring 32 is mounted, by inclining the plate spring 32, an outwardly bent piece 32*b* which is not provided with a notched section 321 is inserted between the inner bottom face of the seal member 27 and the fixing projections 31*a,* 31*b* towards one longitudinal end of the seal member 27 as shown in FIG. 20 or FIG. 21 in the same manner as the eighth embodiment. The notched section 322 is fitted into the corresponding fixing projections 31*a,* 31*b* in the same region as described in the eighth embodiment. In such a manner, it is possible to mount the plate spring 32 into the seal member 27. Thus it is possible to obtain the same effect in the ninth embodiment as in the eighth embodiment.

Embodiment 10

The seal member 27 of the containing means 26 described with reference to embodiment 1 to embodiment 9 of the present invention is an integrated unit of a resinous material comprising a mixture of carbon and nylon with self-lubricating properties. In this way, it is possible to reduce wear of the seal member 27 mounted on the valve timing regulation device and to allow smooth relative rotation of the case 4 and the rotor 6 by forming the seal member 27 from a self-lubricating resinous material.

To summarize the effect of the present invention, a seal member and a plate spring are provided in a valve timing regulation device. The seal member has an indented shape in cross section which is inserted into a seal mounting groove provided on the tip of the vane of a second rotating body and the shoe of a first rotating body. The plate spring is fitted into the indented inner section of the seal member and biases the seal member in a direction of abutment with respect to an inner peripheral face of the first rotating body or the outer peripheral face of a boss of the second rotating body. The detachment of the plate spring which is fitted into the indented inner section of the seal member is suppressed and a spring detachment prevention means which allows displacement of the plate spring due to elastic deformation is provided on the seal member. This arrangement allows the plate spring to be integrated with the seal member before assembly into the valve timing regulation device. As a result, when the valve timing regulation device is assembled, both the seal member and the plate spring are integrally inserted into the seal mounting groove. Moreover since the plate spring displaces due to resilient deformation during insertion due to pressure by the bottom face of the seal mounting groove, it is possible to reduce resistance to insertion of the seal member with respect to the seal mounting groove. Thus the seal member may be inserted into the seal mounting groove smoothly and efficiently and the efficiency of the seal member assembly operation may be improved. Furthermore the productivity of the valve timing regulation device can be improved.

The present invention forms a tapering face which is inclined in a partitioning direction with respect to the end face on at least one longitudinal end of the seal member. Thus the tapering face makes it possible to insert the seal member integrated with the plate spring more easily into the seal mounting groove. As a result, the mounting efficiency of the seal member can be further improved. Furthermore since the tapering face is formed near the open end of the indented inner section of the seal member, the tapering face faces the groove bottom of the seal mounting groove with the seal member which is integrated and fits the plate spring in the indented inner section inserted into the seal mounting groove. As a result, the effect is obtained that the containment of the sliding faces of the first rotating body and the second rotating body due to the seal member is not damaged by the tapering face.

The present invention forms an outwardly bent piece on both ends of the central curved section of the plate spring and fixes the outwardly bent piece with a play between the inner bottom face of the seal member and the spring fixing means. Thus detachment of the plate spring is prevented by the outwardly bent piece engaging with the spring fixing means in a direction of detachment of the plate spring from the seal member. When the seal member is inserted into the seal mounting groove, the central curved section of the plate spring is pressed by the groove bottom of the seal mounting groove and the outwardly bent piece of both ends of the plate spring displaces outwardly displaces and expands. In this manner, the plate spring is elastically deformed in a smooth manner in a direction of entering the indented inner section of the seal member.

The present invention forms an inwardly bent piece on both ends of the central curved section of the plate spring and holds a spring fixing means on the inwardly bent piece. Thus it is possible to further ensure the mounting of the plate spring as a unit into the seal member.

The present invention fits and engages a cover on both longitudinal ends on the open end of the indented inner section of the seal member and covers both ends of the plate spring which is fitted into the indented inner section of the seal member with the cover. Thus before mounting the cover, it is possible to fit the plate spring into the indented inner section of the seal member without any resistance. After fitting the plate spring, it is possible to further simplify the mounting of the plate spring with respect to the seal member by merely fitting the cover into the seal member.

The present invention provides a fixing projection as a spring fixing means on an inner section of both side faces of the seal member. A notched section having a shape which allows passage of fixing projections without interfering with the fixing projections is provided on a transverse end face of the plate spring which biases the seal member. The notched section is retained at a position not aligned with the fixing projection which is a position storing the plate spring with respect to an inner section of the seal member. This arrangement allows interference by the plate spring with the fixing projection to be avoided by the notched section during mounting of the plate spring into the inner section of the seal member. As a result, it is possible to perform the mounting operation of the plate spring simply and efficiently and to improve the productivity of the mounting operation. Furthermore the effect is obtained that it is possible to prevent plastic deformation of the plate spring and the generation of fragments due to the top of the fixing projection being cut by the side edge of the plate spring due to such interference.

After mounting the plate spring, that is to say, at the position at which the plate spring is housed with respect to the inner section of the seal member, since the notched section is retained at a position which is not aligned with the fixing projection, the plate spring does not detach from the inner section of the seal member. Thus the effect is obtained that it is possible to perform smooth assembly of the unit comprising the seal member and the plate spring by a means such as automatic insertion into the valve timing regulation device.

Since the present invention forms a reinforcing cladded section on an inner bottom corner on both longitudinal sides of the seal member, the effect is obtained that it is possible to prevent both side walls of the seal member from deforming outwardly due to the pressure of the plate spring on the indented inner section of the seal member.

The present invention forms a fixing projection as a spring fixing means. The fixing projection faces plate spring at a position sandwiching both edges to create a space between the inner bottom face of the seal member. The fixing projection projects from both inner side faces of the seal member. Thus it is possible to perform simple mounting of the plate spring integrated with the seal member by merely pressing the plate spring through the fixing projection into the indented inner section of the seal member. Thus the effect is obtained that the productivity of the containing means is improved by this type of mounting.

The present invention forms a seal member from a resinous material having self-lubricating properties. Thus wear on the seal member mounted on the valve timing regulation device can be reduced and it is possible to increase the smoothness of the relative rotation of the first rotating body and the second rotating body.

The present invention forms a notched section on both ends of the central curved section of the plate spring and on the transverse end faces of the outwardly bent piece which is engaged with a play between the inner bottom face of the seal member and the fixing projection. Thus it is possible to displace the notched sections to a position aligned opposite to the fixing projection by the bending deformation of the central curved section of the plate spring in a direction in which the mutual outwardly bent piece on both ends of the centrally curved section approaching each other. In such a manner, when the plate spring is mounted onto the seal member inner section, the notched sections make it possible to avoid interference of the plate spring with the fixing projection. As a result, the mounting operation of the plate spring is facilitated, and thus it is possible to improve the efficiency of the mounting operation. Furthermore the effect is obtained that it is possible to prevent the generation of fragments cut from the top of the fixing projection by the side edge of the plate spring due to such interference and the plastic deformation of the plate spring.

According to the present invention, the notched sections are only formed on the outwardly bent piece on one end of the plate spring. Thus it is possible to simplify the mounting of the plate spring with respect to the seal member by aligning the notched sections with the corresponding fixing projection and passing the notched sections through and fixing them to the fixing projections. This is achieved by bending the central curved section of the plate spring after the end of the outwardly bent piece which does not have a notched section is inserted between the fixing projection near one end of the seal member and the inner bottom face of the seal member in the outwardly bent piece on both ends of the plate spring. Thus it is possible to improve the mounting operation and after mounting the plate spring, the effect can be obtained that the separation of the plate spring from the seal member can be prevented by retaining the outwardly bent piece on both ends of the plate spring at a position which allows engagement of the fixing projection on an inner section of the seal member.

According to the present invention, the fixing projection acting as a spring detachment preventing means is formed in a hemispherical or circular cross sectional shape. Thus when the plate spring is pressed and fitted into the indented inner section of the seal member, the plate spring can easily be passed through the fixing projection. As a result, it is possible to facilitate the mounting operation of the plate spring into the seal member.

The present invention comprises opposed fixing projections which project from an inner section of both side faces of the seal member, and a spring pressing member having a hole for fitting the central curved section formed on the plate spring. The spring pressing member is press-fitted between the inner side face of the seal member and the edge of the plate spring to engage with the fixing projection and cover both ends of the seal member. Since the plate spring is adapted to have a width which is narrower than the opposed interval of the fixing projections, when the plate spring is fitted into the inner section of the seal member, there is no effect on the fixing projection. As a result, the effect is obtained that it is possible to fit the plate spring simply into the seal member without any resistance. When the hole of the spring pressing member is fitted into the central curved section of the plate spring, it is possible to press-fit and guide the plate spring easily into the inner section of the seal member. After press-fitting, the effect is obtained that it is possible to assemble the plate spring into the seal member in order to cover both ends of the plate spring and engage the spring pressing member with the fixing projection.

The present invention forms the spring pressing member in the shape of a flat rectangular frame. The spring pressing member has a hole for fitting into the central curved section of the plate spring. The side plate sections on both longitudinal sides contact with both edges of the seal member and are press-fitted into an inner section of the seal member through the fixing projection. Thus the plate spring can be guided and the spring pressing member can be press-fitted easily and in a stable manner into the inner section of the seal member. Press-fitting allows the effect that the plate spring can be mounted without rattling on the seal member.

The present invention is provided with a fixing step for fixing the spring to both inner longitudinal ends of the seal member. The plate spring which fits into the inner section of the seal member is formed in a waveform which has a backwardly curved sections on both ends of the plate spring. The stem of the backwardly curved sections abuts on two positions of the inner bottom face of the seal member and resiliently engages the end of each backwardly curved section with the fixing step. Thus when the plate spring is mounted on the seal member, it is possible to retain the plate spring in a stable manner with the inner section of the seal member. As a result, it is possible to resiliently engage the end -of each backwardly curved section in a simple manner with the fixing step and the effect can be obtained that the plate spring is strongly mounted on the seal member. Since a spring deformation prevention projection is provided which can abut with the central curved section of the plate spring during resilient deformation, it is possible to prevent abnormal deformation of the plate spring by pressuring the central curved section of the plate spring more than required.

What is claimed is:

1. A valve timing regulation device comprising:

a first rotating body having a plurality of shoes on an inner peripheral face, the first rotating body being rotated by an output of an internal combustion engine;

a second rotating body having a plurality of vanes on an outer peripheral face of a boss, the second rotating body stored to rotate relative to an inner section of the first rotating body and connected directly to a camshaft of a system opening and closing at least one of an air-intake or exhaust valve of the internal combustion engine;

a retarding oil pressure chamber and an advancing oil pressure chamber formed between the first rotating body and the second rotating body, and between the shoes and vanes;

a plurality of seal mounting grooves individually provided on the tips of the shoes or the vanes;

a plurality of seal members individually inserted into the seal mounting grooves, each seal member having an indented inner section;

a plurality of plate springs individually biasing the seal members in a direction of abutment with an inner peripheral face of the first rotating body or with an outer peripheral face of the boss of the second rotating body, opposite ends of the plate springs individually fitted into the indented inner sections of the seal members, each plate spring being out of contact with opposite walls in a longitudinal direction of the indented inner section; and a plurality of spring fixing means individually provided on the seal members which suppress detachment of the plate springs and allow displacement of the plate springs due to elastic deformation of the plate springs.

2. A valve timing regulation device according to claim 1, wherein the seal members have tapering faces inclined to partition an end face of the seal members, the tapering face being arranged on at least one end in a longitudinal direction and near the open end of the indented inner section.

3. A valve timing regulation device according to claim 1, wherein the plate springs comprise central curved sections, and outwardly bent pieces formed on both ends of the central curved sections, the outwardly bent pieces being fixed with a play between the inner bottom faces of the seal members, and the spring fixing means.

4. A valve timing regulation device according to claim 1, wherein the plate springs comprise central curved sections, and inwardly bent pieces formed on both ends of the central curved sections, the inwardly bent pieces holding the spring fixing means.

5. A valve timing regulation device according to claim 1, wherein the spring fixing means comprises covers fitted and engaged with both longitudinal ends on the open ends of the indented inner sections of the seal members, and covering both ends of the plate springs fitted into the inner sections of the seal members.

6. A valve timing regulation device according to claim 1 further comprising: fixing projections provided as a spring fixing means on both inner side faces of the seal members; and notched sections having a shape allowing passage of the fixing projections and not interfering with the fixing projections, the notched sections being provided on an end face in a transverse direction of the plate springs which bias the seal members, the notched sections being retained at positions not aligned with the fixing projections which is a position storing the plate springs with respect to the inner section of the seal members.

7. A valve timing regulation device according to claim 1, wherein the seal members form a reinforcing cladded section on an inner bottom corners on both longitudinal sides of the seal members.

8. A valve timing regulation device according to claim 1, wherein the spring fixing means comprises fixing projections which project from both inner lateral faces of the seal members and which face a position sandwiching both edges of the plate springs to create a space with the inner bottom face of the seal members.

9. A valve timing regulation device according to claim 1, wherein the first seal members are formed from a resinous material having self-lubrication properties.

10. A valve timing regulation device according to claim 6, wherein the plate springs comprise central curved sections, and outwardly bent pieces formed on both ends of the central curved sections, the outwardly bent pieces being fixed with a play between the inner bottom faces of the seal members and the fixing projections, notched sections being formed on end faces in a transverse direction of the outwardly bent pieces.

11. A valve timing regulation device according to claim 10, wherein the notched sections are formed on the outwardly bent pieces on one end of the plate springs.

12. A valve timing regulation device according to claim 6, wherein the fixing projections are formed in a hemispherical, circular cross-sectional or elliptical cross-sectional shape.

* * * * *